US007874420B2

(12) United States Patent
Coon

(10) Patent No.: US 7,874,420 B2
(45) Date of Patent: Jan. 25, 2011

(54) AFFIXABLE DISPENSING CAPSULE

(76) Inventor: Darren Coon, 68 Lacey La., Brockport, NY (US) 14420

( * ) Notice: Subject to any disclaimer, the term of this patent is extended or adjusted under 35 U.S.C. 154(b) by 104 days.

(21) Appl. No.: 12/368,087

(22) Filed: Feb. 9, 2009

(65) Prior Publication Data

US 2010/0200437 A1 Aug. 12, 2010

(51) Int. Cl.
*B65D 25/08* (2006.01)
*B67D 7/74* (2010.01)

(52) U.S. Cl. ..... 206/219; 222/129

(58) Field of Classification Search ..... 206/219–222; 215/6, DIG. 1; 222/129; 366/130
See application file for complete search history.

(56) References Cited

U.S. PATENT DOCUMENTS 2,653,611 A * 9/1953 Smith ..... 206/222
3,156,369 A 11/1964 Bowes et al.
3,187,918 A 6/1965 Moore
3,321,097 A * 5/1967 Solowey ..... 206/221
3,406,872 A 10/1968 Fiquet et al.
3,439,823 A 4/1969 Morane
3,539,794 A * 11/1970 Kennerly et al. ..... 206/219
3,548,562 A 12/1970 Schwartzman
3,603,469 A 9/1971 Magni
3,802,604 A 4/1974 Morane
3,840,136 A 10/1974 Lanfranconi et al.
3,924,741 A 12/1975 Kachur et al.
3,968,872 A 7/1976 Cavazza
4,024,952 A 5/1977 Leitz
4,167,228 A 9/1979 Cheetham
4,193,698 A * 3/1980 Gartner ..... 366/130
4,195,730 A 4/1980 Hunt
4,195,731 A 4/1980 Cavazza
4,221,291 A 9/1980 Hunt
4,247,001 A 1/1981 Wiegner
4,294,351 A 10/1981 Cheetham (Continued)

FOREIGN PATENT DOCUMENTS

KR 20-0238764 10/2001

(Continued)

OTHER PUBLICATIONS

Lee, Won Jae, PCT/US2010/022922, International Search Report, Jul. 19, 2010, Korean Intellectual Property Office.

(Continued)

*Primary Examiner*—Bryon P Gehman
(74) *Attorney, Agent, or Firm*—Tracy P. Jong

(57) ABSTRACT

A dispensing capsule and method for use thereof, wherein the dispensing capsule is preferably pre-loaded during time of manufacture with a selected dry or liquid ingredient to facilitate subsequent consumer use. The dispensing capsule comprises an apertured housing removably-engagable to the opening of a bottle or container containing a fluid. Preloaded ingredients contained within a cavity in the housing may be introduced or discharged into the bottle by simply depressing a button on the diaphragm of the housing, thereby actuating a breakaway plunger to open an aperture in the opposing base plate of the housing, permitting the contents to flow through the aperture and into the liquid contents of the bottle. The combined contents and liquid within the bottle may subsequently be agitated (e.g., shaken or mixed) without fear or risk of leakage or spillage. A hand held dispensing capsule is also disclosed.

28 Claims, 21 Drawing Sheets

U.S. PATENT DOCUMENTS

| | | | | |
|---|---|---|---|---|
| 4,315,570 | A | 2/1982 | Silver et al. | |
| 4,386,696 | A | 6/1983 | Goncalves | |
| 4,615,437 | A | 10/1986 | Finke et al. | |
| 4,657,534 | A | 4/1987 | Beck et al. | |
| 4,695,468 | A | 9/1987 | Boston | |
| 4,727,985 | A | 3/1988 | McNeirney et al. | |
| 4,798,287 | A | 1/1989 | Groves et al. | |
| 4,883,204 | A | 11/1989 | Kay et al. | |
| 4,898,293 | A | 2/1990 | Morel | |
| 4,903,865 | A | 2/1990 | Janowitz | |
| 5,029,718 | A | 7/1991 | Rizzardi | |
| 5,038,951 | A | 8/1991 | Rizzardi | |
| 5,255,812 | A | 10/1993 | Hsu | |
| 5,292,025 | A | 3/1994 | Dubreul | |
| 5,335,773 | A | 8/1994 | Haber et al. | |
| 5,692,644 | A | 12/1997 | Gueret | |
| 5,769,552 | A | 6/1998 | Kelley et al. | |
| 5,772,017 | A | 6/1998 | Kang | |
| 5,794,802 | A | 8/1998 | Caola | |
| 5,811,060 | A | 9/1998 | Laguna Valderrama | |
| 5,829,638 | A | 11/1998 | Lucas | |
| 5,853,109 | A | 12/1998 | Elliott | |
| 5,863,126 | A | 1/1999 | Guild | |
| 5,927,549 | A | 7/1999 | Wood | |
| 5,947,332 | A | 9/1999 | Klima, Jr. et al. | |
| 5,950,819 | A | 9/1999 | Sellars | |
| 5,988,449 | A | 11/1999 | Fuchs et al. | |
| 6,003,728 | A | 12/1999 | Elliott | |
| 6,056,142 | A | 5/2000 | Elliott | |
| 6,116,445 | A | 9/2000 | Ikemori et al. | |
| 6,148,996 | A | 11/2000 | Morini | |
| 6,180,149 | B1 | 1/2001 | Gramm | |
| 6,290,100 | B1 * | 9/2001 | Yacko et al. | 222/129 |
| 6,305,576 | B1 | 10/2001 | Leoncavallo | |
| 6,367,622 | B1 | 4/2002 | Hsu | |
| 6,372,270 | B1 | 4/2002 | Denny | |
| 6,387,073 | B1 | 5/2002 | Weiler | |
| 6,481,571 | B1 | 11/2002 | Kelders et al. | |
| 6,488,428 | B1 | 12/2002 | Fischer | |
| 6,527,110 | B2 | 3/2003 | Moscovitz | |
| 6,644,471 | B1 | 11/2003 | Anderson | |
| 6,655,525 | B2 | 12/2003 | Song | |
| 6,679,375 | B1 | 1/2004 | Coory | |
| 6,702,161 | B2 | 3/2004 | Adams et al. | |
| 6,705,462 | B2 | 3/2004 | Kasuya | |
| D490,315 | S | 5/2004 | Kiser | |
| 6,766,903 | B1 | 7/2004 | Yehhsu | |
| 6,786,330 | B2 | 9/2004 | Mollstam et al. | |
| 6,840,373 | B2 | 1/2005 | Gibler et al. | |
| 6,854,595 | B2 | 2/2005 | Kiser | |
| 6,959,839 | B2 | 11/2005 | Roth et al. | |
| 6,962,254 | B2 | 11/2005 | Spector | |
| 7,017,735 | B2 | 3/2006 | Carlson | |
| 7,025,200 | B2 | 4/2006 | Fontana | |
| 7,055,684 | B2 | 6/2006 | Anderson | |
| 7,172,095 | B2 | 2/2007 | Marshall | |
| 7,175,037 | B2 | 2/2007 | Deir | |
| 7,175,049 | B2 | 2/2007 | Kastenschmidt et al. | |
| 7,219,796 | B2 | 5/2007 | Anderson | |
| 7,249,690 | B2 | 7/2007 | Smith et al. | |
| 7,306,117 | B2 | 12/2007 | Roth et al. | |
| 7,325,676 | B2 | 2/2008 | Galaz Rodriguez | |
| 7,337,921 | B2 | 3/2008 | Ma | |
| 7,568,576 | B2 * | 8/2009 | Sweeney et al. | 206/219 |
| 2007/0205218 | A1 * | 9/2007 | Mueller et al. | 222/129 |
| 2007/0251910 | A1 | 11/2007 | Mastin | |

FOREIGN PATENT DOCUMENTS

| | | |
|---|---|---|
| KR | 20-0383181 | 5/2005 |

OTHER PUBLICATIONS

Raija Ahvenainen, Novel Food Packaging Techniques, pp. 182-184, Woodhead Publishing Limited and CRC Press LLC.

Shigley and Mischke, Mechanical Engineering Design—Fifth Edition, p. 57, section 2-15 Stress Concentration, ISBN 0-07-056899-5, 1989, McGraw-Hill, Inc., Printed in the USA.

* cited by examiner

AFFIXABLE DISPENSING CAPSULE

TECHNICAL FIELD

The present device relates generally to dispensing capsules, and more specifically, to a dispensing capsule for removable engagement with a liquid-containing bottle and enabling dry or liquid ingredients contained within the dispensing capsule to be conveniently deposited into a bottle and mixed with the liquid contents thereof. A hand held dispensing capsule is also provided.

BACKGROUND OF THE INVENTION

The movement to decrease transportation costs, packaging size, environmental waste and valuable store shelf space has increased the demand for innovative packaging for a wide range of products. Many products are sold as liquid concentrates, crystals and powders to be mixed with a liquid prior to consumption or use. Such products include foods, drugs, cosmetics, adhesives, polishes, cleansers, dyes, infant formula, drink mixes, meal replacements, protein powders, energy mixes, supplements, nutritional products and other substances. Some of these products do not retain their stability, strength and effectiveness for long after they have been mixed in solution or suspension, yet the product can be stored for extended periods of time if one ingredient is maintained separate from the other. This necessarily requires that the product be utilized relatively soon after mixture to prevent deterioration, spoilage, interactions and the like. Well known illustrative examples include epoxy adhesives, infant formula and enzyme enriched nutritional products.

Simultaneously, the active on-the-go lifestyle has also fueled the demand for portable, disposable and convenient product delivery packaging that delivers a premeasured amount of one ingredient for mixing with a measured amount of a liquid to insure that the desired solution concentration is obtained. Manufacturers are presented with a number of challenges in merchandising of products of this genre. In order to supply two companion products to the consumer in a single package, it obviously is desirable that both ingredients be sold as part of the same package such that a single package be utilized for maintaining such compounds separated.

Consumers are also presented a number of challenges in using these products. Consumers often purchase large containers or bulk quantities of infant formulas, drink mixes, meal supplement or nutritional powders. A small single serving portion of such powder or drink mix must be combined with water or other suitable liquids for consumption. However, the inconveniences associated with the use of such large containers of powders or mixes is well known. Consumers must undertake the time-consuming and often messy process of properly combining and mixing the powder with a container of liquid, measuring and depositing the appropriate amount of liquid or powder within the container and, thereafter, shake, stir or otherwise fully mix the combined contents. In doing so, powder and/or powder-liquid mix often spills, resulting in mess and partial loss of product.

To address these challenges, containers have been designed with two compartments in which two ingredients may be stored separately until it is desired to mix them, at which time it is possible to establish communication between the compartments so that the separated ingredients may move from one compartment to the other. It is known in the art to provide dispensers containing a concentrate of soluble materials to a fixed quantity of solute, usually water, for dispensing. Generally, the interior of the container is divided into a compartment having a liquid and a compartment which can be selectively ruptured by a user so as to mix the separately stored liquid or powder material on demand.

There are several drawbacks and limitations with the prior art containers of this type and design. Prior art containers are generally manufactured of a plurality of separate components that come together to form the breakaway. These multiple component designs are more expensive to manufacture and offer a less reliable seal that is subject to mechanical failure under pressure or temperature changes that accompany transportation and long term storage of the end product. Many of the prior art designs also offer a fully detached breakaway component that introduces dangerous nonconsummable loose material into the consumable solution. This may cause a choking hazard and should preferably be avoided, especially in applications such as infant formula. Other prior art designs offer a partially detached breakaway that tends to obstruct the delivery of the capsule contents or undesirably provide a place for contents to aggregate rather than mix into the solution.

Thus, it is desirable to provide an improved mixing cap or dispensing capsule that may be selectively and detachably mounted on a liquid-containing bottle or container enabling dry or liquid ingredients contained within the dispensing capsule to be conveniently deposited into the container and mixed with the liquid contents thereof that has none of the drawbacks or limitations of the prior art.

SUMMARY OF THE INVENTION

The present device overcomes the shortcomings of the prior art by providing one or more structures and methods for selectively securing and detachably mounting a dispensing capsule to a liquid containing bottle or container. A hand held dispensing capsule is also provided where mounting to a receiving container is not necessary. The present device discloses a dispensing capsule. Enhancements include (1) a breakaway plunger that fully detaches at its periphery while remaining attached to the shaft such that it does not fall away from the shaft and/or into the fluid cavity after it has been opened, (2) predictably distributing an activating force across the breakaway plunger by providing a breakaway plunger having stress concentrators, (3) minimizing a mechanical failure of a seal on a breakaway dispenser due to pressure differences between the dispenser's interior and exterior by providing a single injection molded dispensing capsule and breakaway plunger unit and/or a non-perforated uniform seal at the periphery of the breakaway plunger, (4) uniform and more expedient mixing of the consumable contents of a breakaway dispenser with a fluid in the receiving container by a conical shaped plunger having blades in a multitude of orientations configured to cause turbulence during agitation of the receiving container, and (5) a predictable break pattern in a breakaway dispenser by providing a breakaway plunger having stress concentrators with varying stiffness disposed along the periphery such that when the breakaway plunger is activated, the stress concentrators cause a uniform seal at the periphery to detach according to the magnitude of stress generated at each stress concentrator.

Briefly described, in a preferred embodiment, the present device overcomes the above-mentioned prior art disadvantages, and meets the recognized need for such a device by providing a dispensing capsule and method for use thereof, wherein the dispensing capsule is preferably pre-loaded during time of manufacture with a selected dry or liquid ingredient to facilitate subsequent consumer use. The novel dispensing capsule comprises an apertured housing with a diaphragm operably attached to a shaft having a breakaway plunger at one end and a diaphragm button on the opposing end, and a cavity disposed in the housing for consumable product defined by side walls and a base plate. In some aspects, mounting flange arrangements are integrally formed therewith. Preloaded ingredients contained within the hermetically sealed housing may be introduced or discharged from the dispensing capsule and/or into a liquid containing receiving container (e.g., bottle) by simply depressing a button disposed on the diaphragm of the housing, thereby actuating the breakaway plunger to open an aperture in the opposing end of the housing, permitting the contents to flow through the aperture and exit the cavity of the housing. The combined contents and liquid within the receiving container may subsequently be agitated (e.g., shaken or mixed) without fear or risk of leakage or spillage.

The housing is preferably pre-loaded during time of manufacture with a selected dry or liquid ingredient to facilitate subsequent consumer use; however, it is also contemplated that the cavity may be loaded with a selected ingredient at the time of initial consumer use (i.e., post-manufacture). In this aspect, the dispensing capsule may be either disposable or reusable. The present dispensing capsule is preferably removably engageable to the mouth of a conventional personal-sized water bottle, infant feeding bottle or other liquid-containing bottle; however, it should be recognized that the technology of the present device may be appropriately modified to accommodate the various structural properties of a selected liquid containing container, including, without limitation, mouth diameter, flanged mouths, threaded or unthreaded mouths, and/or the like. The housing may also be configured as a hand held device, for example, in the form of a pen or syringe style device or integrally formed with a receiving container as a single unit.

The housing may be integrally packaged as a sealed unit comprising the dispensing capsule and bottle/container. Both the bottle and the dispensing capsule are preferably preloaded during time of manufacture with a selected ingredients; however, it is also contemplated that either or both the dispensing unit and bottle may be loaded with a selected ingredient at the time of initial consumer use (i.e., post-manufacture).

The housing preferably comprises a diaphragm functioning as a top wall in communication with a cylindrical-shaped sidewall. The housing's aperture is located on the base plate correspondingly in communication with the cylindrical-shaped sidewall. The aperture is opposingly disposed from a button at the center of the diaphragm. The button, a shaft and a plunger are axially aligned and operably connected to one another. The plunger and base plate are preferably conical shaped. The plunger extends through the aperture when in the open position. The conical shaped base plate and conical shaped cone of the plunger facilitates dispersion of the consumable contents and minimizes obstruction.

Slideable movement of the housing within the bottle is preferably restricted via a mounting flange externally disposed, preferably at the top or bottom of the housing as appropriate for the desired mounting configuration. The general mounting flange arrangement of the dispensing capsule further provides an effective sealing means during use of the present device.

When the dispensing capsule is in a "closed position", the preloaded ingredients or contents are maintained within the cavity (e.g. storage receptacle) of the housing by virtue of the juncture between the aperture, plunger and the base plate of the housing functioning as an effective seal between the storage receptacle and fluid compartment of the bottle or ambient environment surrounding the dispensing capsule.

When in the open position, the cavity of the housing is in fluid communication with the fluid compartment of the bottle or ambient environment surrounding the dispensing capsule. To place the dispensing capsule into an "open position", so that the contents of the cavity of the housing may be introduced or discharged into the communicating bottle or air, the button on the diaphragm is sufficiently depressed or forcefully pushed to downwardly thrust the shaft and attached plunger to cause a predictable tear pattern and the plunger is introduced into the fluid cavity or air; thus, enabling the contents thereof to flow through the aperture of the base plate and into the liquid contents of the bottle or air. Preferably, the conical shaped plunger and base wall facilitates such flow, and prevents settling or accumulation of the contents thereon. The combined ingredients and liquid within the bottle may subsequently be agitated (shaken) without fear or risk of leakage or spillage. Following the shaking process, consumption of the fully mixed solution may be had by the user. For sake of clarity, the activation is described in terms of pushing downwardly, however, it is to be appreciated that other configurations and directions are contemplated and considered within the spirit and scope of the present device. As will be apparent to one skilled in the art, the direction of force will align with the shaft axis.

Accordingly, a feature and advantage of the present device is its ability to facilitate the introduction of a dry/liquid ingredient into a bottle, without risk of spillage of the ingredient.

Another feature and advantage of the present device is its ability to facilitate the mixing of a dry/liquid ingredient with the contents of a bottle, without risk of spillage of the ingredient or bottle contents.

Still another feature and advantage of the present device is its ability to provide a preloaded mixing cap or dispensing capsule.

Still another feature and advantage of the present device is its ability to provide a bottle or containers having two compartments in which two ingredients (one of which is a liquid) may be stored separately until it is desired to mix them, at which time it is possible to establish communication between the compartments so that the separated ingredients may move from one compartment to the other.

Yet another feature and advantage of the present device is its ability to provide a dispensing capsule that may be loaded at time of initial consumer use.

Still yet another feature and advantage of the present device is its ability to provide a dispensing capsule, the contents of which may be introduced or discharged into a bottle or the air by simply depressing the diaphragm of the dispensing capsule.

It is yet another object of the present device to provide a portable dispensing capsule that may be mounted to fluid containing containers and bottles of varying sizes and configurations.

Still yet another feature and advantage of the present device is its ability to provide a dispensing capsule that eliminates or minimizes obstruction in the material dispensing path due to partially detached breakaway flaps.

Still yet another feature and advantage of the present device is its ability to provide a dispensing capsule with a breakaway plunger that fully detaches at its periphery while remaining attached to the shaft such that it does not fall into the fluid cavity after it has been opened.

Still yet another feature and advantage of the present device is its ability to provide a dispensing capsule that fully disperses its contents into the fluid cavity of a receiving container or the air surrounding the dispensing capsule.

Still yet another feature and advantage of the present device is its ability to provide a dispensing capsule that predictably distributes an activating force across the breakaway plunger.

Still yet another feature and advantage of the present device is its ability to provide a dispensing capsule that eliminates or minimizes a mechanical failure of a seal on a breakaway dispenser due to pressure differences between the dispenser's interior and exterior.

Still yet another feature and advantage of the present device is its ability to provide a dispensing capsule that facilitates uniform mixing of its consumable contents with a fluid in the receiving container.

Still yet another feature and advantage of the present device is its ability to provide a dispensing capsule having a predictable break pattern.

It is yet another object of this device to provide a dispensing capsule that is relatively economical from the viewpoint of the manufacturer and consumer, is susceptible to low manufacturing costs with regard to labor and materials, and which accordingly is then susceptible of low prices for the consuming public, thereby making it economically available to the buying public.

Whereas there may be many embodiments of the present device, each embodiment may meet one or more of the foregoing recited objects in any combination. It is not intended that each embodiment will necessarily meet each objective.

In this respect, before explaining at least one embodiment of the device in detail, it is to be understood that the invention is not limited in its application to the details of construction and the arrangements of the components set forth in the following description or illustrated in the drawings. The present device is capable of other embodiments and of being practiced and carried out in various ways.

PARTICULAR ADVANTAGES OF THE INVENTION

Partially detached breakaway flaps obstruct the dispersion path of the dispensing capsule's contents. The present device provides a dispersion capsule with a breakaway plunger that fully detaches at its periphery while remaining attached to the shaft such that it does not fall into the fluid cavity after it has been opened. This provides the additional advantage that loose material (packaging components) is not introduced into the consumable solution. Obstruction is further minimized by the present device by providing a shaft that is secured at one end to a breakaway plunger and at an opposing end is secured to a diaphragm button such that the breakaway plunger is restricted to vertical movement along a central axis of the shaft and transmits an axially applied force to the diaphragm button to the seal such that it fully detaches the periphery of the breakaway plunger. Full dispersion of the contents into the fluid cavity of a receiving container is achieved with an inclined surface on the breakaway plunger and base plate.

A single injection molded dispensing capsule and breakaway plunger unit as well as a non-perforated uniform seal at the periphery of the breakaway plunger eliminates mechanical failure of multiple component breakaway units.

Stress concentrators advantageously provide a means of predictably distributing an activating force to selected portions of the breakaway plunger and/or that concentrate the axial force and direct it to small specific portions of the seal that are equally distributed around the periphery of the breakaway plunger. These stress concentrators can have a blade shape to additionally facilitate uniform and more expedient mixing of the consumable contents of the dispensing capsule with a fluid in the receiving container. The unique design of a conical shaped plunger having blades in a multitude of orientations configured to cause turbulence during agitation of the receiving container provides obvious advantages to the user.

A predictable break pattern is provided by a breakaway plunger having stress concentrating ribs with varying stiffness and/or geometry disposed along the periphery such that when the breakaway plunger is activated, the stress concentrating ribs cause a uniform seal at the periphery to detach according to the magnitude of stress generated at each stress concentrating rib.

BRIEF DESCRIPTION OF THE DRAWINGS

The invention will be described by reference to the specification and the drawings, in which like numerals refer to like elements, and wherein.

The drawings are not to scale, in fact, some aspects have been emphasized for a better illustration and understanding of the written description.

PARTS LIST

2—dispensing capsule (upper flange style capsule)
2A—dispensing capsule (bottom flange style capsule)
4—diaphragm (top wall of housing)
5—housing
6—mounting flange (upper flange style capsule)
6A—mounting flange (bottom flange style capsule)
7—threaded opening of receiving container (bottle mouth)
8—button
8A—bubble button style
8B—ripple button style
9—securing cap
10—cylindrical shaped side wall
11—aperture of housing
12—base plate
13—breakaway plunger
14—shaft
15—cavity in housing interior for consumable product
17—diaphragmatic seal
16—enlarged view
18—consumable material (ingredient)
20—fluid
22—receiving container (bottle)
24—airtight or hermetic aperture seal around breakaway plunger
25—direction of flow path of consumable contents
26—direction of activation force
28—stress concentrators
28A—upper stress concentrator portion
28B—lower stress concentrator portion
30—infant feeding bottle
32—peripheral fluid channels
36—central fluid channel
38—shaft guide
40—direction of installation
42—lid (with shaft guide and diaphragm)
44—indents on diaphragm to correspond with peripheral fluid channels
46—agitating mechanism
48—blades
50—cavity
52—inactivated diaphragm (bottom flange style capsule)
54—activated diaphragm (bottom flange style capsule)
56—inactivated diaphragm with ripple button (bottom flange style capsule)
58—infant feeding nipple
60—threaded portion of nipple cap
62—mating threaded portion of infant feeding bottle at nipple attachment
64—threaded portion of securing cap
66—mating threaded portion of infant feeding bottle at dispensing capsule attachment
68—threaded portion of sprayer bottle
70—sprayer

72—tube
74—detent in shaft to receive shaft guide
76—detent in breakaway plunger to receive shaft
78—threaded portion of mounting flange
80—concave portion of base plate
82—threaded portion of housing
84—threaded portion of lid
86—protruding lip

DETAILED DESCRIPTION OF A PREFERRED EMBODIMENT

The use of conventional liquid containers such as plastic bottles for carrying water, juices, and other desirable liquids for human consumption is quite well known. The present device is generally directed to a dispensing capsule that may be used with such bottles or containers to separately store an ingredient to be mixed with a liquid at the time of consumption to form a consumable solution. In describing the preferred and alternate embodiments of the present device, as illustrated in the Figures, specific terminology is employed for the sake of clarity. The invention, however, is not intended to be limited to the specific terminology so selected, and it is to be understood that each specific element includes all technical equivalents that operate in a similar manner to accomplish similar functions.

Figure 1A:
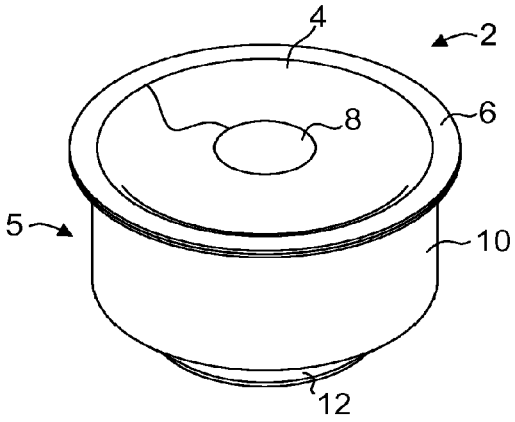
FIG. 1A is a top perspective view of a dispensing capsule.
Figure 1B:
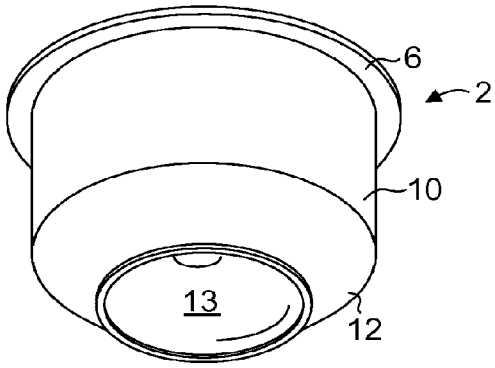
FIG. 1B is a bottom perspective view of a dispensing capsule.
Figure 1C:
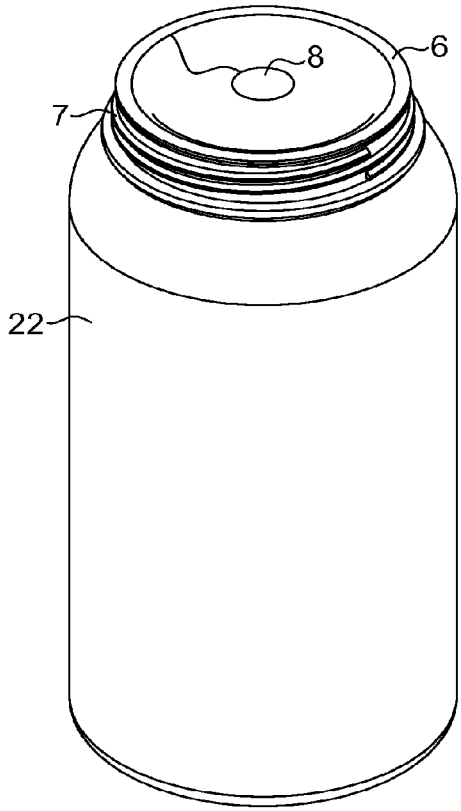
FIG. 1C is a perspective view of a dispensing capsule in combination with a bottle.
Figure 2:
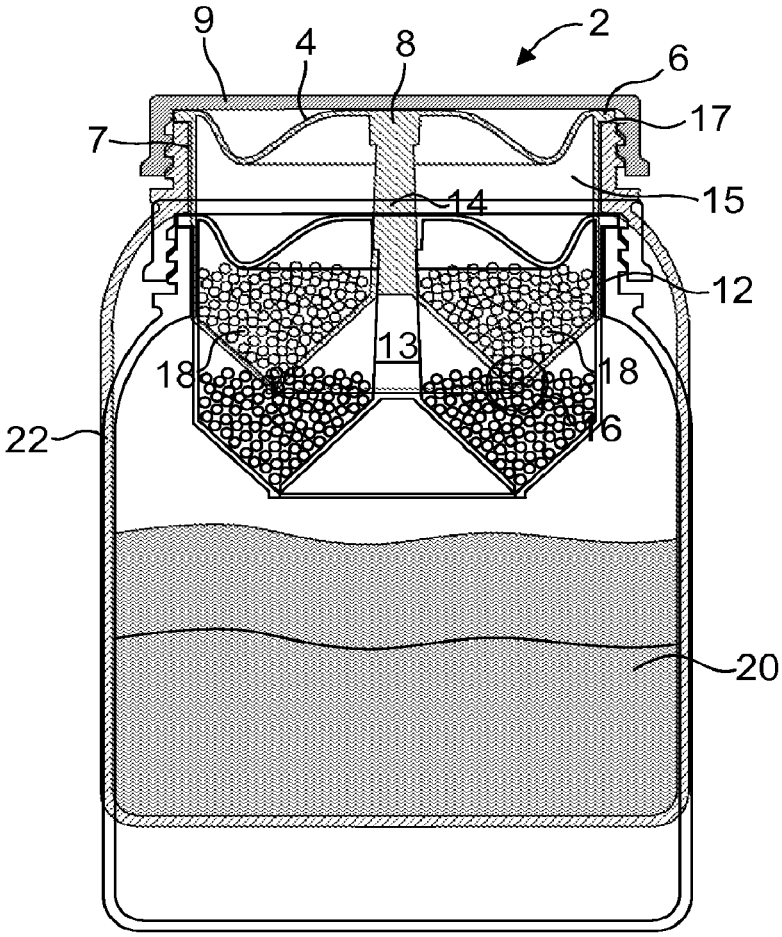
FIG. 2 is a cross section view of a dispensing capsule in combination with a bottle.
Figure 2A:
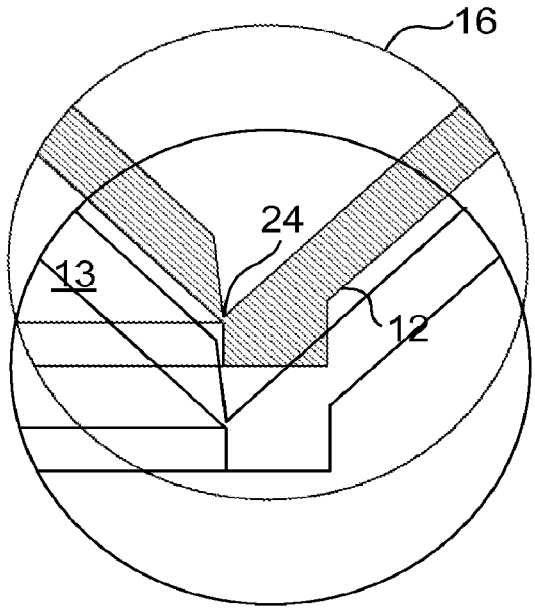
FIG. 2A is a cross section detailed view of 16 of FIG. 2.

FIG. 1A is a top perspective view, and FIG. 1B is a bottom perspective view, of one embodiment of a dispensing capsule 2 of the present device. In this embodiment, the dispensing capsule 2 is configured with an upper mounting flange 6 and thus will be referred to herein as the upper flange style capsule. FIG. 1C is a perspective view of this dispensing capsule 2 in combination with a receiving container 22 (e.g. bottle). FIG. 2 is a cross section view of a dispensing capsule 2 in combination with a receiving container (e.g., bottle) 22 and FIG. 2A is a cross section detailed view of 16 of FIG. 2.

Referring now to FIGS. 1A, 1B, 1C and 2, the present device in its preferred embodiment is a dispensing capsule 2 and method for use thereof, wherein the novel dispensing capsule 2 comprises an apertured housing 5 with a diaphragm 4 operably attached to a shaft 14 having a breakaway plunger 13 at one end and a diaphragm button 8 on the opposing end, a cavity 15 disposed in the housing 5 interior for consumable product 18 defined by a cylindrical side wall 10 and a base plate 12, and mounting flange arrangements 6 integrally formed therewith. The housing 5 of the dispensing capsule 2 comprises a breakaway plunger 13 and a base plate 12 having an aperture 11 that cooperate to form a seal 24 between the cavity 50 and a fluid compartment of the receiving container 22. the housing 5 further comprises a diaphragm button 8 disposed in axial alignment with the breakaway plunger 13 and a shaft 14 that is connected at one end to the diaphragm button 8 and at the other end to the breakaway plunger 13.

Figure 3A:
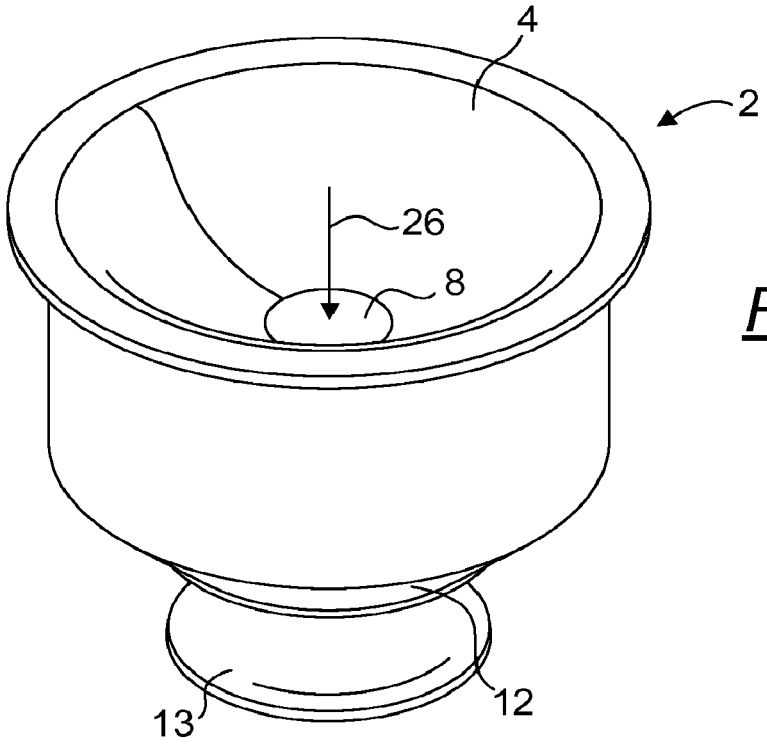
FIG. 3A is a top perspective view of an alternate embodiment of a dispensing capsule.
Figure 3B:
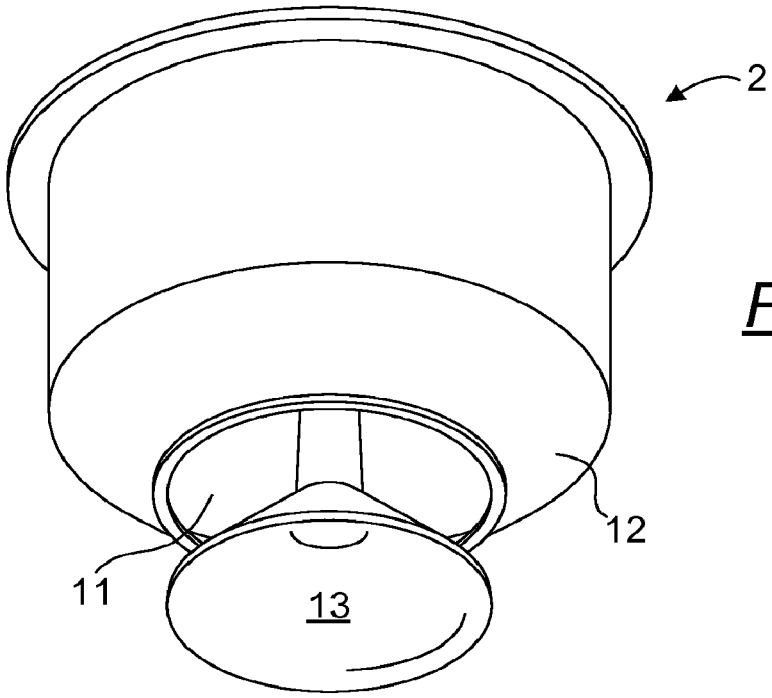
FIG. 3B is a bottom perspective view of the dispensing capsule depicted in FIG. 3A.
Figure 4:
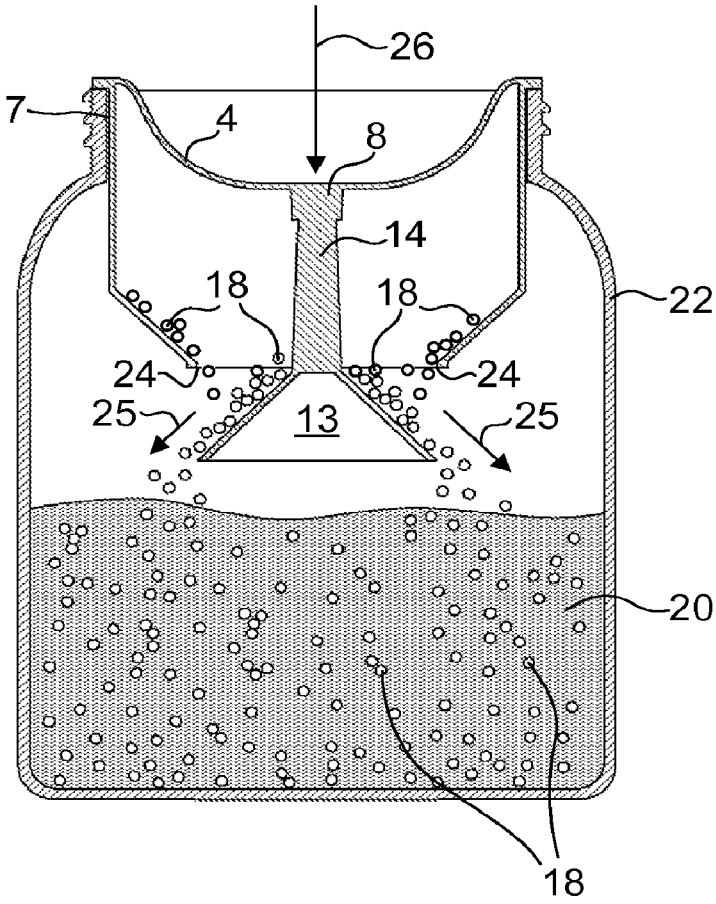
FIG. 4 is a cross section view of the dispensing capsule depicted in FIG. 3A in combination with a bottle.
Figure 4A:
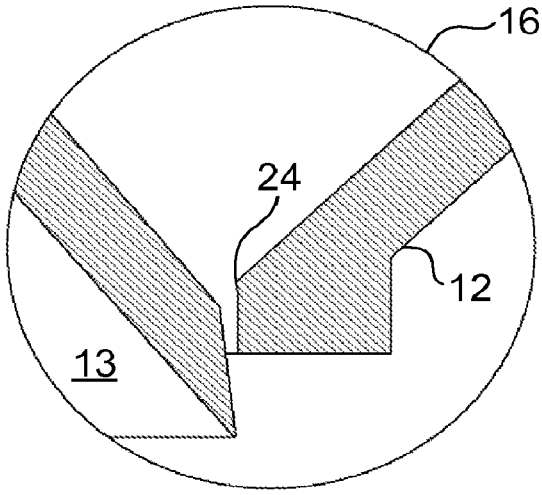
FIG. 4A is a cross section detailed view of 16 of FIG. 2 with the dispensing capsule in the activated position.

FIG. 3A is a top perspective view of the activated (open position) dispensing capsule and FIG. 3B is a bottom perspective view of the activated dispensing capsule depicted in FIG. 3A. FIG. 4 is a cross section view of the dispensing capsule depicted in FIG. 3A in its activated or open position in combination with a bottle. Continuing to refer to FIGS. 1-2, and also referring to FIGS. 3 and 4, preloaded consumable product ingredients 18 contained within the housing 5 may be introduced or discharged into the liquid 20 containing receiving container 22 (e.g., bottle) by simply applying an activating force 26 to (e.g., depressing) a button 8 disposed on the diaphragm 4 of the housing 5, thereby actuating the breakaway plunger 13 to open an aperture 11 in the opposing end of the housing 5, permitting the consumable product 18 contents to flow through the aperture 11 and into the liquid contents 20 of the bottle 22. The combined consumable product contents 18 and liquid 20 within the bottle 22 may subsequently be agitated (e.g., shaken or mixed) without fear or risk of leakage or spillage.

It should be noted that the general arrangement of, and interaction between, the mounting flange 6 and the opening 7 of the receiving container 22 provide an effective sealing means during use of the present device, and particularly during the shaking process hereof. In some aspects, a securing cap 9 is used to secure the dispensing capsule 2 to the opening of the receiving container 22.

It is contemplated that the housing 5 and its cavity 50 may be manufactured in any selected volumetric size so as to provide a variety of preloaded, or loadable, dispensing capsules 2 adapted to facilitate the ingestion or consumption of accurately measured quantities of consumable product 18.

Figure 9A:
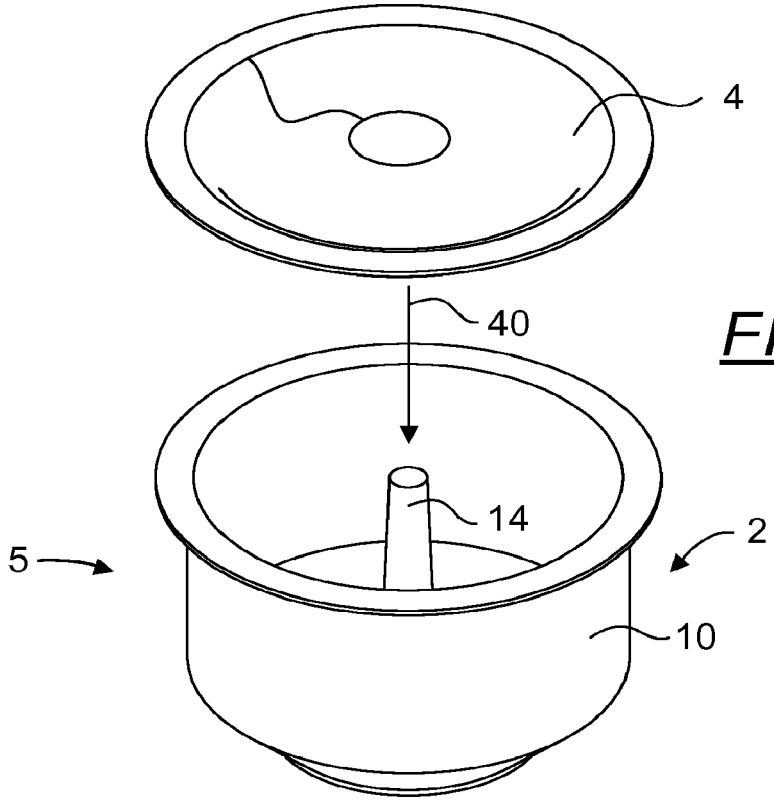
FIG. 9A is an exploded perspective view of an alternate embodiment of a dispensing capsule.
Figure 9B:
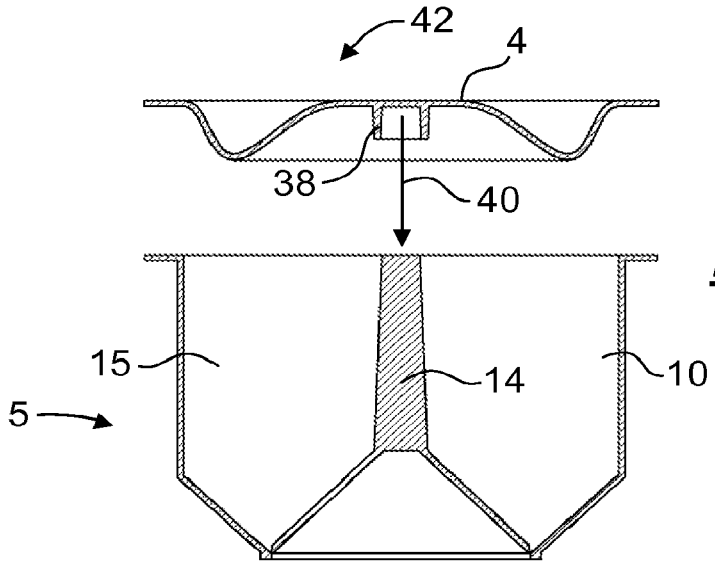
FIG. 9B is an exploded cross sectional view of the embodiment of a dispensing capsule depicted in FIG. 9A.

Continuing to refer in particular to 1A, 1B, 1C, 2 and 2A, the dispensing capsule 2 preferably comprises a housing 5 formed of cylindrical side wall 10 and base plate 12. The top wall of the housing is a diaphragm 4 that may be integrally formed with the cylindrical side wall 10 or a separate component that may be affixed thereto. FIGS. 9A and 9B will be discussed in greater detail later, but illustrate an embodiment where the diaphragm 4 is in the form of a lid 42 that forms a separate component. By way of illustration, in applications where the dispensing capsule 2 is prefilled by the manufacturer, an integrally formed housing 5 (diaphragm 4, side wall 10 and base plate 12) is preferable, while in applications where the dispensing capsule 2 is filled post-manufacture, a separate removable diaphragm 4 (see lid 42 of FIG. 9B) is preferable to facilitate access to the cavity 15 for filling. It is also contemplated in an alternate embodiment (not depicted) that the diaphragm 4 be integrally formed with the cylindrical side wall 10 and the base plate 12 be removably affixed thereto to facilitate filling of the cavity 15.

Figure 15:
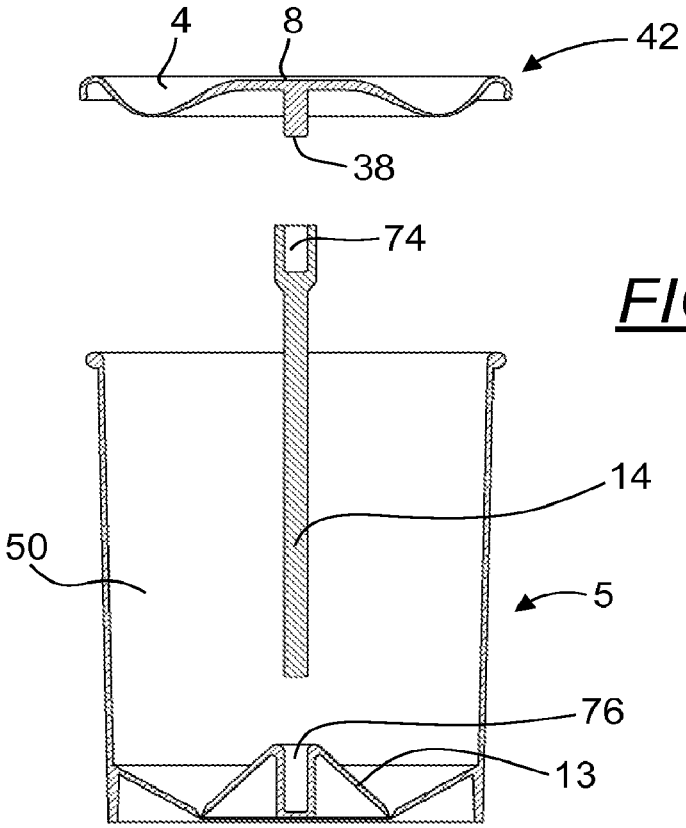
FIG. 15 is an orthogonal cross section view of another embodiment of a dispensing capsule depicted in unassembled form.
Figure 16:
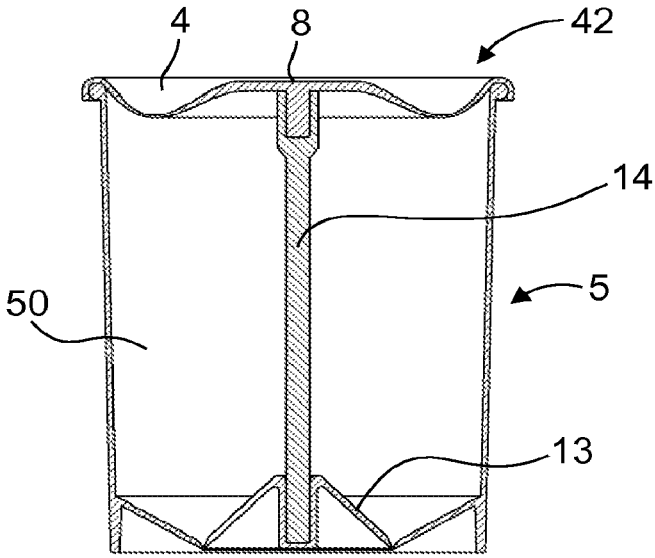
FIG. 16 is an orthogonal cross section view of the dispensing capsule depicted in FIG. 15 in assembled form.

FIGS. 15 and 16 depict an embodiment of the dispensing capsule where the shaft 14 is a separate component from the breakaway plunger 13 and lid 42. FIG. 15 depicts the dispensing capsule in its unassembled form and FIG. 16 depicts the dispensing capsule in its assembled form. The shaft 14 fastens between the housing 5 (cup) and lid 42 (having diaphragm 4 and shaft guide 38). This embodiment is particularly useful for longer dispensing capsules with greater volume. In the embodiment depicted, the shaft 14 has a detent 74 or cavity at one end that mates with and receives the corresponding shaft guide 38 on the bottom of the lid 42. The opposing end of the shaft 14 is received by a corresponding detent 76 in the breakaway plunger 13. As will be appreciated, these components 14, 13, 42 may be affixed to one another in various manners and configurations. The exemplary embodiment depicted affixes these component parts 13, 14, 42 by compression fit to avoid the necessity of additional parts or adhesives.

Referring generally to FIGS. 1-4, dispensing capsule 2 is preferably formed from a suitable plastic substrate, such as, for exemplary purposes only, polyethyleneterephalate (PET), and with sufficient structural rigidity to prevent deformation, breakage and/or tearing of same during implementation of the present method. The housing and breakaway components are preferably formed via injection molding processes. Additionally, during time of manufacture, and preferably prior to assembly, of dispensing capsule 2, the cavity 15 of the housing 5 is pre-loaded with a selected dry or liquid consumable product 18 to facilitate subsequent consumer use; however, and as more fully described below, it is contemplated that housing cavity 15 may be loaded with a selected consumable product 18 at time of initial consumer use (i.e., post-manufacture) (reference is made again to FIGS. 9A, 9B, 15 and 16). It should be recognized that other suitable materials or substrates may be utilized to form dispensing capsule 2, such as, for exemplary purposes only, polymers, plastics, metals, metal alloys, ceramics, or the like.

Figure 7A:
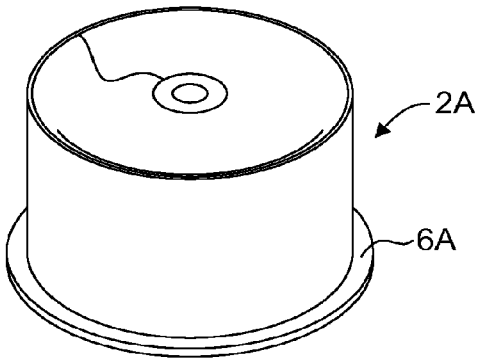
FIG. 7A is a top perspective view of a dispensing capsule.
Figure 7B:
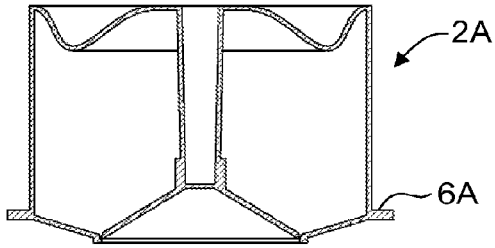
FIG. 7B is a cross section view of a dispensing capsule.

Preferably formed on and around the cylindrical side wall 10 and/or the diaphragm 4 is rounded mounting flange 6 dimensioned such that it extends and protrudes outwardly from the housing 5; that is, the mounting flange 6 is preferably diametrically larger than the diameter of the housing 5. This mounting flange 6 may be configured as an upper mount style (see FIG. 1A) or a bottom mount style 6A (see FIG. 7A) as desired for a particular application or receiving container configuration. FIG. 7A is a top perspective view of a bottom flange style dispensing capsule 2A and FIG. 7B is a cross section view of the dispensing capsule 2A.

Referring generally to FIGS. 1-9, when the dispensing capsule 2 is disposed in the opening 7 of the receiving container 22 (for holding the liquid), the dispensing capsule 2 is prevented from slideable interaction and movement between the opening 7 of the bottle 22 and the dispensing capsule 2. The mounting flange 6 also creates a lip that may be conveniently used to grab for easy insertion and removal of the dispensing capsule 3 in the bottle opening 7.

Figure 7C:
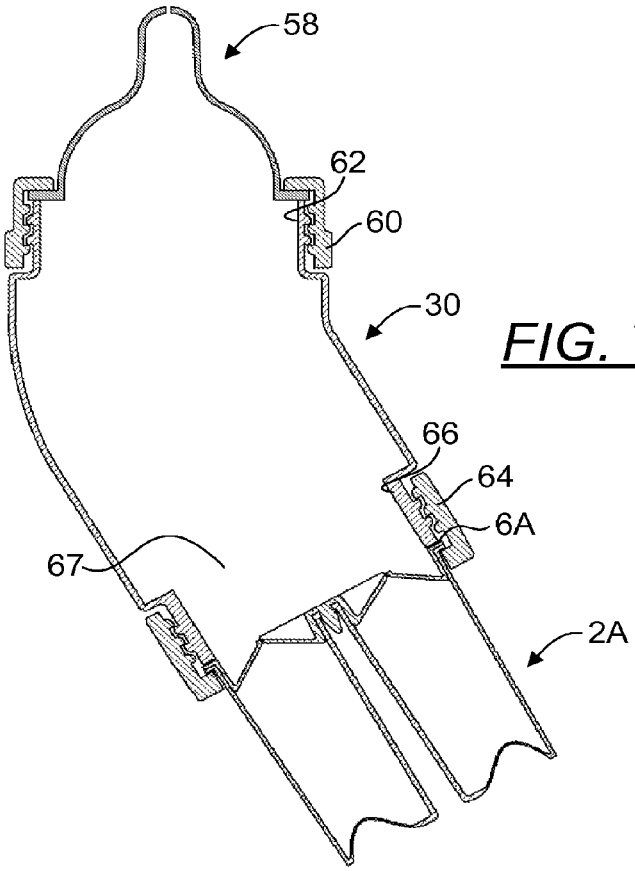
FIG. 7C is an orthogonal cross section view of a dispensing capsule in combination with an infant feeding bottle.

The mounting flange 6 also provides a means for securing the dispensing capsule 2 about the bottle opening 7. FIG. 7C is an orthogonal cross section view of a dispensing capsule 2A in combination with an infant feeding bottle 30. By way of illustration, and with reference to FIG. 7C, a threaded securing cap 64 may be screwed to the appropriate opening 67 of the infant feeding bottle 30 in such a manner that the mounting flange 6A of the dispensing capsule 2A is secured about mating threaded portion 66 of infant feeding bottle 30 at dispensing capsule attachment portion. This would work in a similar fashion to prior art arrangements for securing an infant feeding nipple 58 by affixing the threaded portion of nipple cap 60 to the mating threaded portion of infant feeding bottle at nipple attachment 62.

Figure 17:
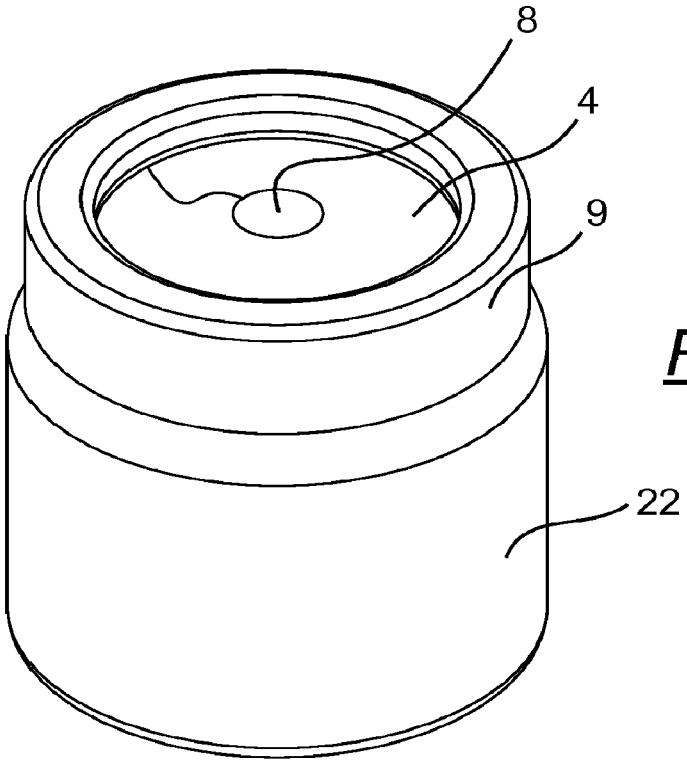
FIG. 17 is a perspective view of another embodiment of a dispensing capsule.
Figure 18:
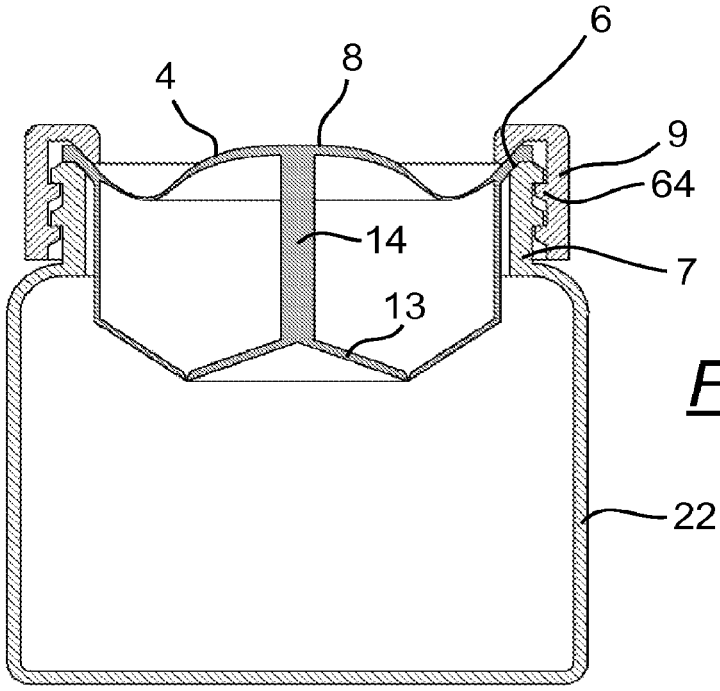
FIG. 18 is an orthogonal cross section view of the dispensing capsule depicted in FIG. 17.

In a similar fashion, FIGS. 17 and 18 depict an embodiment of the dispensing capsule that seals between the bottle wedge seal of the receiving container 22. The mating threaded portions 64 of securing cap 9 secures the mounting flange 6 to the threaded opening 7 of the receiving container 22. This embodiment is particularly useful for wide mouth receiving containers 22 (such as Nalgene style water bottles).

Although dispensing capsule 2 is preferably threadably-engaged to the opening 7 of a receiving container 22 (mouth of a bottle), it should be recognized that the technology of the present device may be appropriately modified to accommodate the various structural properties of any selected receiving container 22 (bottle), including, without limitation, mouth diameter, flanged mouths, threaded or unthreaded mouths, and/or the like. As such, it is contemplated that dispensing capsule 2 may be coupled to an unthreaded opening of a receiving container via frictional-fit. It is also contemplated that there are hand held embodiments of the dispensing capsule that are not mounted to a receiving container (see for example, FIGS. 23-31).

The housing's cavity 15 is preferably pre-loaded during time of manufacture with a selected dry or liquid consumable product 18 to facilitate subsequent consumer use; however, it is also contemplated that the cavity 15 may be loaded with a selected consumable product 18 at the time of initial consumer use (i.e., post-manufacture). In this aspect, the dispensing capsule 2 may be either disposable or reusable. The present dispensing capsule 2 is preferably removably engageable to the mouth 7 of a conventional personal-sized water bottle 22, infant feeding bottle 30 or other liquid-containing bottle; however, it should be recognized that the technology of the present device may be appropriately modified to accommodate the various structural properties of a selected container, including, without limitation, mouth diameter, flanged mouths, threaded or unthreaded mouths, and/or the like.

Figure 19:
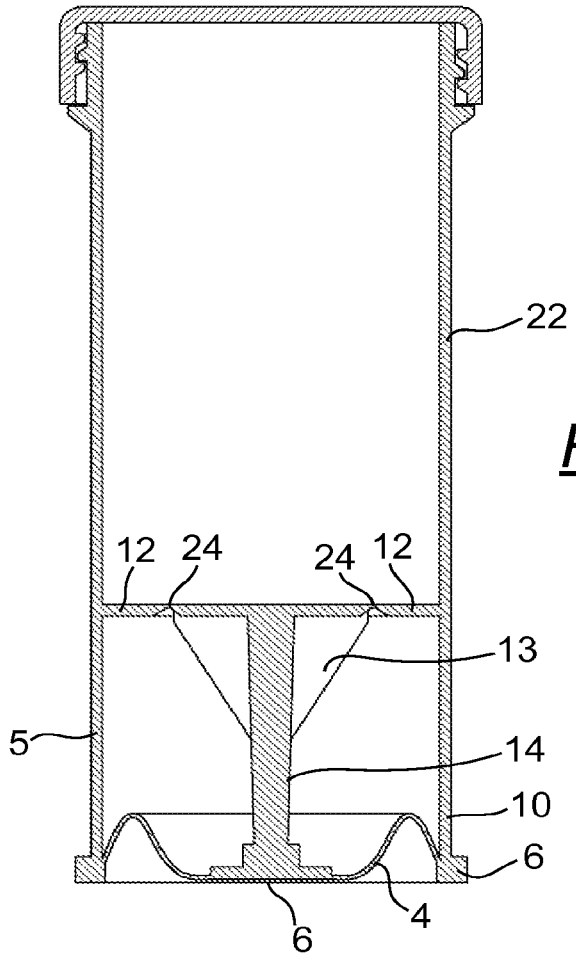
FIG. 19 is an orthogonal cross section view of another embodiment of a dispensing capsule integrally formed with a receiving container.

The housing 5 may be integrally packaged as a sealed unit comprising the dispensing capsule 2 and bottle/container 22. Both the bottle 22 and the dispensing capsule 2 are preferably pre-loaded during time of manufacture with a selected consumable ingredients; however, it is also contemplated that either or both the dispensing unit and bottle may be loaded with a selected ingredient at the time of initial consumer use (i.e., post-manufacture). FIG. 19 depicts an embodiment where the dispensing capsule is integrally formed with the receiving container 22. As depicted, mounting flange 6 is integrally formed with the housing 5 wall 10 and the breakaway plunger 13 and base plate 12 cooperate to form the seal 24 at the bottom of the fluid compartment.

The housing 5 preferably comprises a diaphragm 4 functioning as a top wall in communication with a cylindrical-shaped sidewall 10. The housing's aperture 11 is located on the base plate 12 correspondingly in communication with the cylindrical-shaped sidewall 10. The aperture 11 is opposingly disposed from a button 8 at the center of the diaphragm 4. The button 8, a shaft 14 and a breakaway plunger 13 are axially aligned and operably connected to one another. The breakaway plunger 13 and base plate 12 are preferably conical shaped. Although not essential, any inclined shape (pyramidal, conical and the like) of the base plate 12 and breakaway plunger 13 (plunger cone 13 in the embodiment depicted) is preferred. As more clearly visible in FIGS. 3A, 3B and 4, the breakaway plunger 13 extends through the aperture 11 when in the open position. The conical shaped base plate 12 and conical shaped cone of the breakaway plunger 13 facilitates dispersion of the consumable product 18 contents and minimizes obstruction. An inclined (conical or pyramidal shaped) breakaway plunger 13 and housing 5 base plate 12 facilitates full dispersion of the cavity 15 contents 18 into the receiving container 22. Gravitation force is all that is required to urge the cavity 15 contents 18 toward the receiving container 22.

The diaphragm creates a flexible cavity volume such that an excessive pressure in the sealed cavity is relieved, such as when there are pressure variance between the inside and outside of the cavity.

Slideable movement of the dispensing capsule 2 within the receiving container 22 is preferably restricted via an externally disposed mounting flange 6, preferably at the top or bottom of the housing 5 as appropriate for the desired mounting configuration. The general mounting flange arrangement of the dispensing capsule 2, 2A further provides an effective sealing means during use of the present device.

When the dispensing capsule 2 is in a "closed position" (see FIGS. 1A, 1B, 2A and 2B), the preloaded consumable product 18 are maintained within the cavity 15 (e.g. storage receptacle) of the housing 5 by virtue of the juncture between the aperture 11, breakaway plunger 13 and the base plate 12 of the housing 5 functioning as an effective seal between the storage receptacle 15 and fluid compartment of the bottle 22.

When in the open position (see FIGS. 3A, 3B and 4), the cavity 15 of the housing 5 is in fluid communication with the fluid compartment of the receiving container 22. To place the dispensing capsule 2 into an "open position", so that the contents of the cavity 15 of the housing 5 may be introduced or discharged into the communicating receiving container 22, the button 8 on the diaphragm 4 is sufficiently depressed 26 or forcefully pushed to downwardly thrust the shaft 14 and attached breakaway plunger 13 to cause a predictable tear pattern and the breakaway plunger 13 is introduced into the fluid compartment of the receiving container 22; thus, enabling the consumable product 18 contents thereof to flow 25 through the aperture 11 of the base plate 12 and into the liquid contents 20 of the receiving container 22. Preferably, the conical shaped breakaway plunger 13 and base wall 12 facilitates such flow, and prevents settling or accumulation of the consumable product thereon (about the hermetic seal 24). The combined consumable product 18 and liquid 20 within the receiving container 22 may subsequently be agitated (shaken) without fear or risk of leakage or spillage. Following the shaking process, consumption of the fully mixed solution may be had by the user. For sake of clarity, the activation force 26 is described in terms of pushing downwardly, however, it is to be appreciated that other configurations and directions are contemplated and considered within the spirit and scope of the present device. As will be apparent to one skilled in the art, the direction of applied force 26 will align with the shaft 14 axis.

Many prior art mixing caps use separate components (buttons, seals, and the like) that come together to form the breakaway. The separate components are typically sealed temporarily by fusing, mechanical force, or adhesive. Mechanical failure of seals is experienced during transportation, handling, and long term storage. These are often the result of temperature and pressure changes, more specifically, the pressure differential between the interior and exterior of the dispensing capsule. The problem of mechanical failure of seals in breakaway dispensers is solved by the present device with a single injection molded dispensing capsule 2 and breakaway plunger 13 unit. Additionally, the present device has a non-perforated uniform seal 24 at the periphery of the breakaway plunger 13. This uniform seal 24, preferably created by a single injection molding process, eliminates weak structural points of multiple component designs that can lead to mechanical failure of the seal 24. This configuration provides a durable, reliable hermetic seal 24 that will not rupture during transportation and handling through a broad range of temperatures and physical agitation. This configuration provides additional advantages in that it is less expensive to manufacture, offers a more reliable seal and more durable overall dispensing capsule 2.

FIGS. 11A, 11B, 11C, 11D and 11E disclose various configurations and arrangements for the breakaway seal 24 formed at the juncture between base plate 12 and breakaway plunger 13. These illustrative examples should be deemed exemplary and not limiting.

A breakaway plunger 13 that fully detaches at its periphery while remaining attached to the shaft 14 prevents the breakaway plunger 13 from falling into the fluid 20 after it has been opened, preventing loose material (packaging components) being introduced into the consumable solution where it may be ingested. This also minimizes obstruction in the material dispensing path caused by a partially detached breakaway flap.

Without the aid of a diaphragm or guide, a non-co-axial force applied to the plunger 13 would cause one portion of the seal 24, or undesired areas of the base plate 12, to experience higher stress, creating a situation where the breakaway 13 remained partially attached. Since the shaft 14 is secured at one end to the breakaway plunger 13 and at the opposing end to the diaphragm button 8, the breakaway plunger 13 is restricted to vertical movement along the shaft 14 axis (it can only move up and down and not from side to side). It functions to guide the force 26 applied to the diaphragm button 8 to the seal 24 in the desired predictable pattern such that it fully detaches the complete periphery of the breakaway plunger 13. The breakaway plunger is disposed concentrically to the diaphragm such that a non-axial force applied to a button on the diaphragm is transmitted axially through the breakaway plunger to create stress on the seal thereby causing it to break away.

In applications where a trap door type configuration for the breakaway is preferred or desired, the breakaway plunger 13 of the present device can be sufficiently adapted such that the breakaway seal 24 is less than the full 360 degrees and that at least a portion of seal 24 remains affixed to the breakaway plunger 13 and/or base plate 12.

Figure 5A:
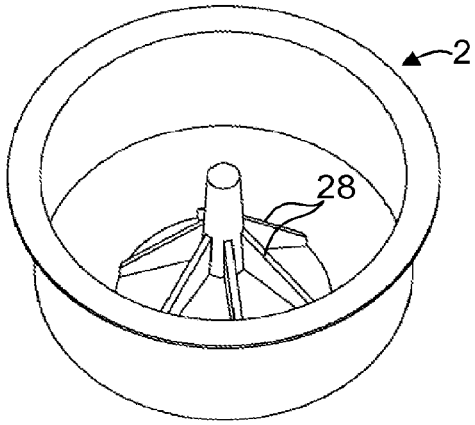
FIG. 5A is a top perspective view of a dispensing capsule with the diaphragm removed.
Figure 5B:
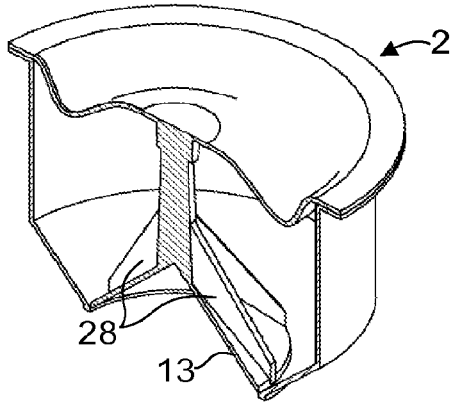
FIG. 5B is a cut out perspective view of a dispensing capsule.
Figure 5C:
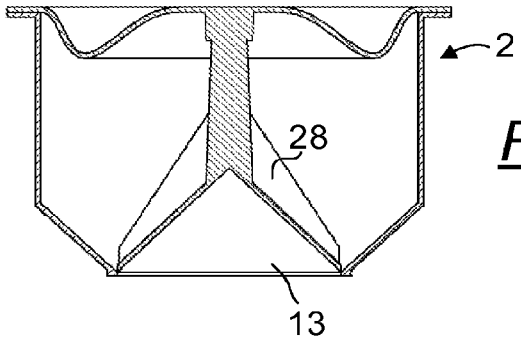
FIG. 5C is a cross section view of a dispensing capsule.
Figure 5D:
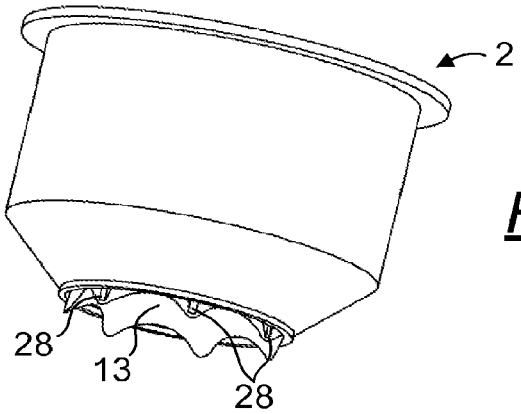
FIG. 5D is a bottom perspective view of a dispensing capsule.

FIG. 5A is a top perspective view of a dispensing capsule with the diaphragm removed. FIG. 5B is a cut out perspective view of a dispensing capsule. FIG. 5C is a cross section view of a dispensing capsule. FIG. 5D is a bottom perspective view of a dispensing capsule. Referring generally to FIGS. 1-5, the breakaway must be substantially durable to avoid accidental rupture, yet gentle enough to rupture when a relatively small amount of force 26 is applied directly to the diaphragm button 8. Stress concentrators 28 direct the initial activation force 26 in a desired pattern that distributes the force over a smaller area (such that each smaller area receives a greater amount of the total activation force 26). As well known in the art, the shape (geometry), thickness and dimensions determine the stiffness of a stress concentrator. A stiffer stress concentrator will cause a break to occur first in that region. Stress concentrators 28 advantageously provide a means of predictably distributing an activating force 26 to selected portions of the breakaway plunger 13 and/or that concentrate the orthogonal force 26 and direct it to small specific portions of the seal 24 that are equally distributed around the periphery of the breakaway plunger 13. Referring especially to FIG. 5D, applying an activation force 26 initially causes the breakaway areas directly adjacent to the stress concentrators 28 to rupture away from the breakaway plane. The breakaway then progressively rips on either side of the ruptures until the breakaway 13 is completely severed from the housing 5. The plurality of stress concentrators 28 distribute an applied force axially via the breakaway plunger 13 to predetermined portions of the seal 24 equally disposed along the periphery 24 of the breakaway plunger 13 such that when the breakaway plunger 13 is activated, the stress concentrators 28 cause the uniform seal 24 to rupture and detach at the predetermined portions of the seal where stress is generated by the stress concentrators 28 followed by a progressive ripping on either side of the predetermined portions until the seal has been broken around the entire periphery 24 of the breakaway plunger 13.

Figure 6A:
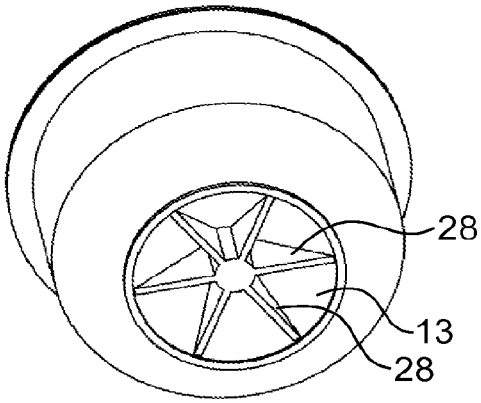
FIG. 6A is a bottom perspective view of a dispensing capsule.
Figure 6B:
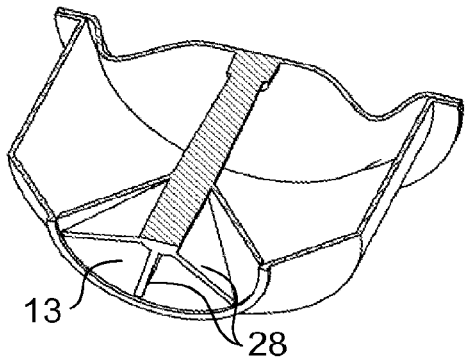
FIG. 6B is a cut out perspective view of a dispensing capsule.
Figure 6C:
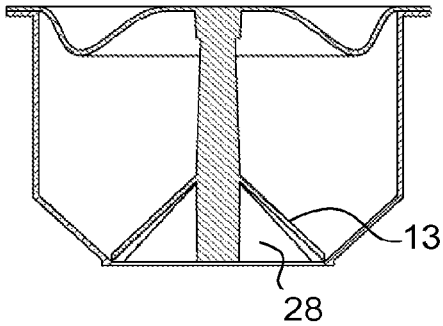
FIG. 6C is a cross section view of a dispensing capsule.
Figure 6D:
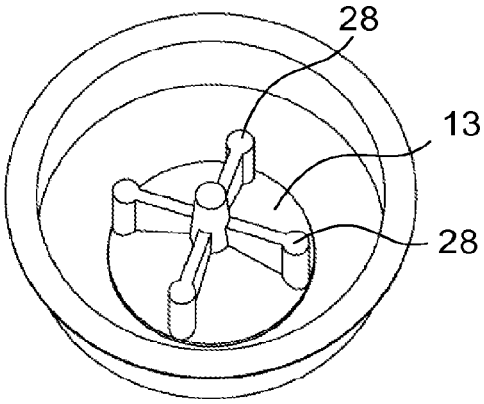
FIG. 6D is a top perspective view of a dispensing capsule with the diaphragm removed.
Figure 6E:
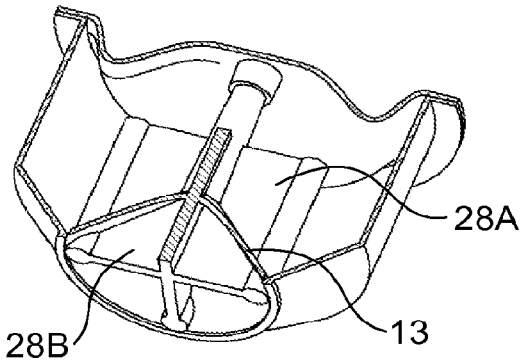
FIG. 6E is a cut out bottom perspective view of a dispensing capsule.

FIG. 6A is a bottom perspective view of a dispensing capsule. FIG. 6B is a cut out perspective view of a dispensing capsule. FIG. 6C is a cross section view of a dispensing capsule. FIG. 6D is a top perspective view of a dispensing capsule with the diaphragm removed. FIG. 6E is a cut out bottom perspective view of a dispensing capsule. In this aspect of the stress concentrator, there is provided an upper stress concentrator portion 28A and a lower stress concentrator portion 28B. These stress concentrators 28 also advantageously facilitate uniform and more expedient mixing of the consumable product 18 of the dispensing capsule 2 with a fluid 20 in the receiving container 22 with the unique design of a conical shaped plunger 13 having blades 48 in a multitude of orientations configured to cause turbulence during agitation of the receiving container 22. These blades 48 are essentially the upper stress concentrator portion 28A and/or lower stress concentrator portion 28B of the agitating mechanism 46.

Figure 12:
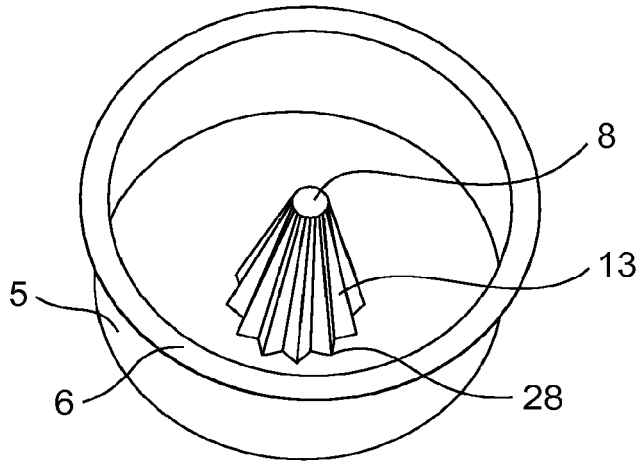
FIG. 12 is a top perspective view of an alternate embodiment of a dispensing capsule.
Figure 13:
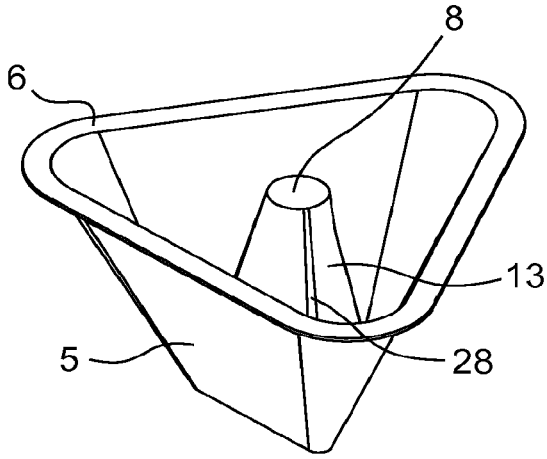
FIG. 13 is a top perspective view of an alternate embodiment of a dispensing capsule.
Figure 14A:
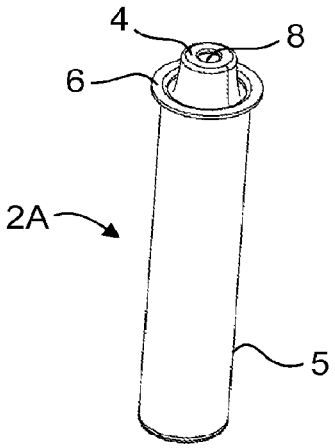
FIG. 14A is a perspective view of another embodiment of a dispensing capsule.
Figure 14B:
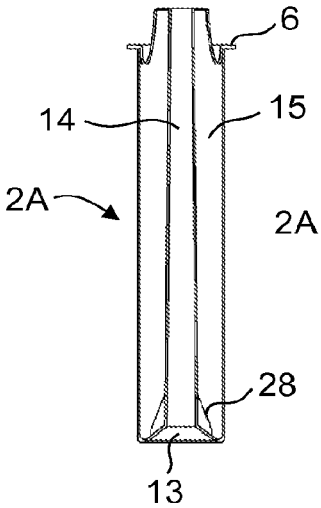
FIG. 14B is an orthogonal cross section view of a dispensing capsule depicted in FIG. 14A in the closed position.
Figure 14C:
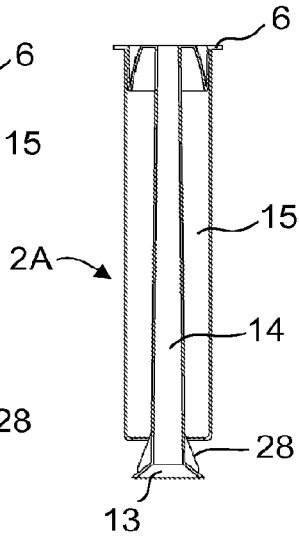
FIG. 14C is an orthogonal cross section view of a dispensing capsule depicted in FIG. 14A in the open position.
Figure 14D:
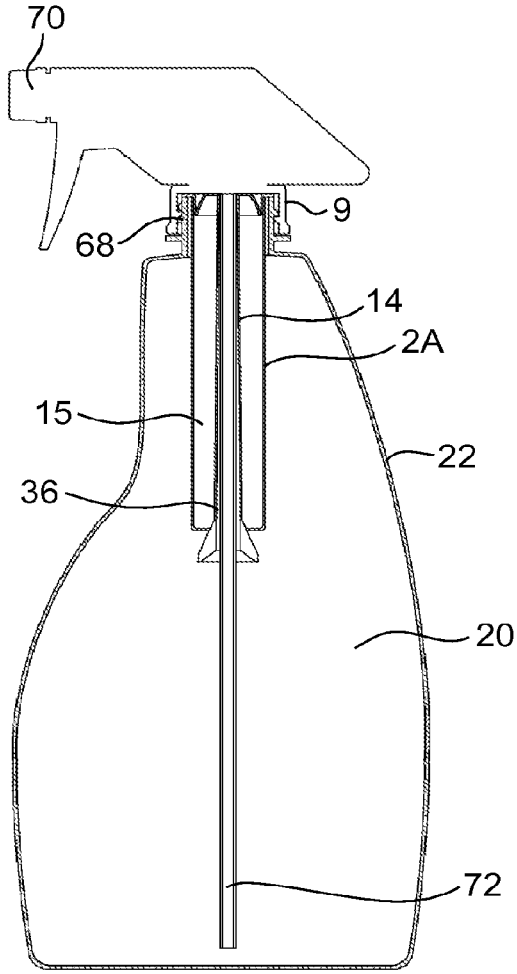
FIG. 14D is an orthogonal cross section view of a dispensing capsule depicted in FIG. 14A in the open position in combination with a sprayer bottle.

FIGS. 12 and 13 depict alternate embodiments of the dispensing capsule having varying shapes and configurations for the housing 5 and mounting flange 6 (upper flange style capsule). As will be apparent to one skilled in the art, stress concentrators 28 can take various forms with the stress creating structural features being created by geometry and/or materials.

Figure 20:
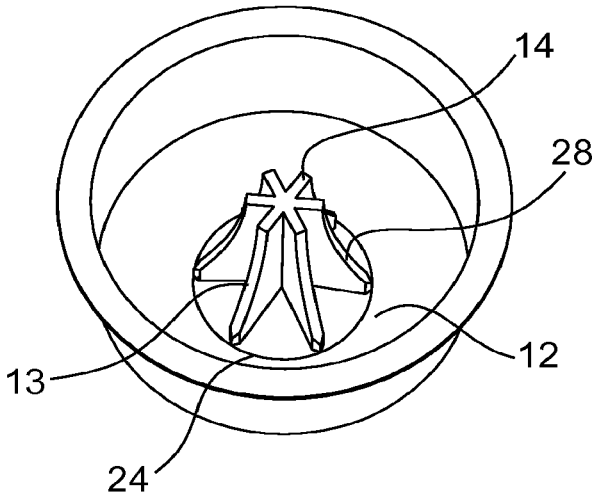
FIG. 20 is a top perspective view of another embodiment of a dispensing capsule with the diaphragm removed.

FIG. 20 depicts an embodiment of the dispensing capsule where the breakaway plunger 13 and shaft 14 are integrally formed as a continuation of the stress concentrators 28.

A predictable break pattern is provided by a breakaway plunger 13 having stress concentrating ribs 48 with varying stiffness disposed along the periphery such that when the breakaway plunger 13 is activated, the stress concentrating ribs 28 cause a uniform seal 24 at the periphery to detach according to the magnitude of stress generated at each stress concentrating rib 28.

Referring to FIGS. 9A and 9B, a reusable dispensing capsule 2 embodiment is comprised of (1) a housing "cup" having a shaft 14 and a breakaway plunger 13 and (2) a lid 42 having a diaphragm 4, a button 8, a seal and a shaft guide 38 such that the shaft guide 38 guides the lid 42 onto the shaft 14 and removably affixes it thereto. As will be readily appreciated, many configurations for removably affixing these components together may be suitably adapted to the present device. By way of illustration, the interface between the cup and lid may be inset or have a flange. Different geometry for joining the lid 42 and housing 5 (cup) may be used, including but not limited to, snap fit, ultrasonic weld, spin weld, screw, adhesive, plastic over-mold, stake weld, laser weld, induction weld, and the like.

It is contemplated in yet another alternate embodiment that housing 5 could comprise a rigid seal disposed between storage cavity 15 of the housing 5 and the aperture 11. In such an embodiment, depressing the diaphragm button 8 would effectively cause the shaft 14 to push against the rigid seal and dislodge the breakaway plunger 13 from its resting position; thus enabling mixture of preloaded consumable product 18 with the liquid 20 contents of the receiving container 22. The foregoing embodiment may alternatively utilize a rupturable seal.

It is contemplated in yet another alternate embodiment that the exterior surface of the housing 5 and/or mounting flange 6 could comprise a rigid seal.

Figure 8A:
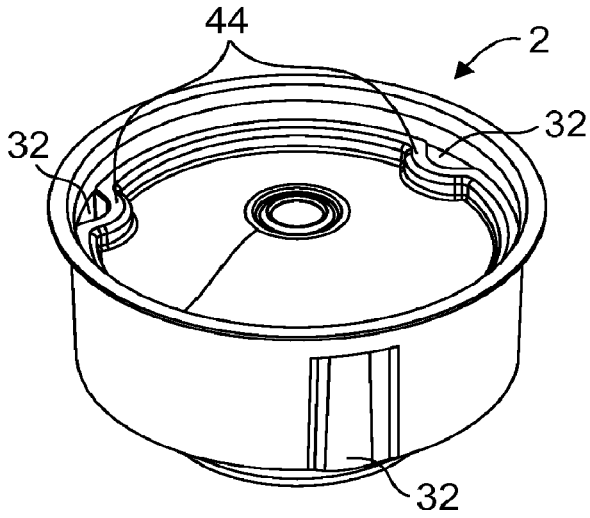
FIG. 8A is a top perspective view of an alternate embodiment of a dispensing capsule.
Figure 8B:
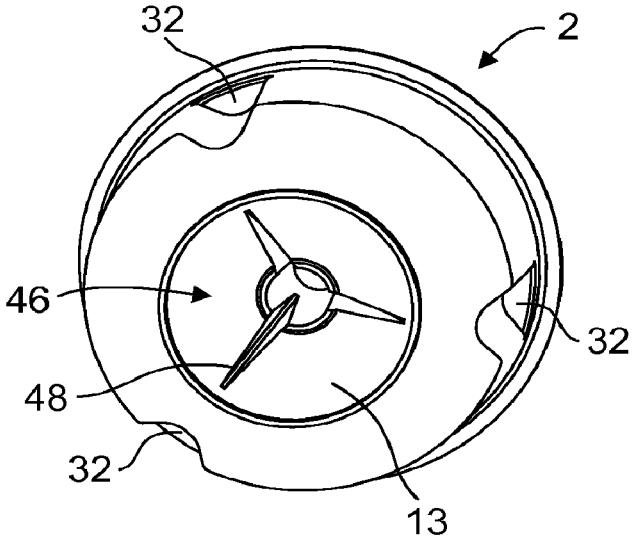
FIG. 8B is a bottom perspective view an alternate embodiment of a dispensing capsule.

FIG. 8A is a top perspective view of an alternate embodiment of a dispensing capsule with peripheral fluid channels 32 that allow the passage of fluid. In this aspect, the dispensing capsule may remain in the receiving container 22 during use. Correspondingly, there are provided fluid channel indents 44 on the diaphragm to correspond with peripheral fluid channels 32. The solution formed from the consumable product 18 and the liquid 20 passes through the peripheral fluid channels 32 where it can be consumed (drank) by the user. FIG. 8B is a bottom perspective view an alternate embodiment of a dispensing capsule. Similar to the embodiment depicted in FIGS. 5-6, an agitating mechanism 46 comprises a plurality of blades 48 that function to cause turbulence, mixing the solution upon agitation of the receiving container. These blades 48 may also be the stress concentrators 28, or may be a separate component.

Figure 8C:
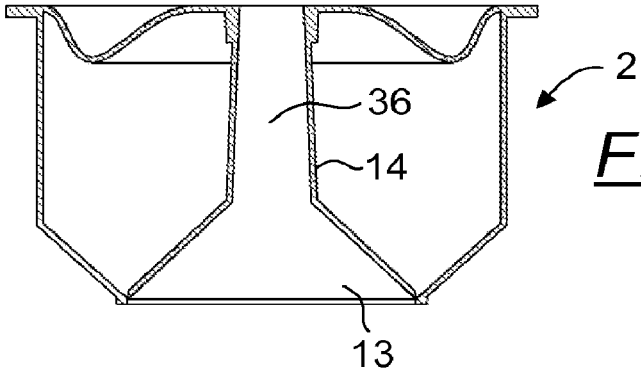
FIG. 8C is an orthogonal cross section view of a dispensing capsule.

Other configurations of the fluid channel are contemplated. By way of illustration, FIG. 8C is an orthogonal cross section view of a dispensing capsule with a central fluid channel 36.

Figure 10A:
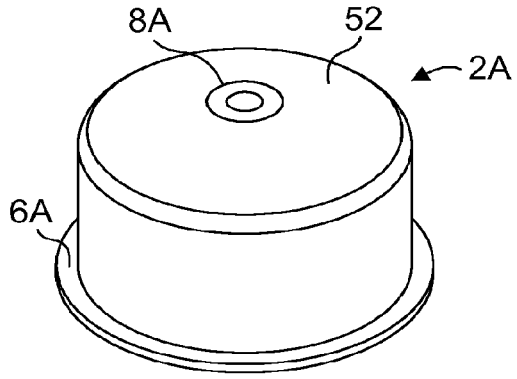
FIG. 10A is a top perspective view of a dispensing capsule with a bubble button diaphragm in the closed (inactivated) position.
Figure 10B:
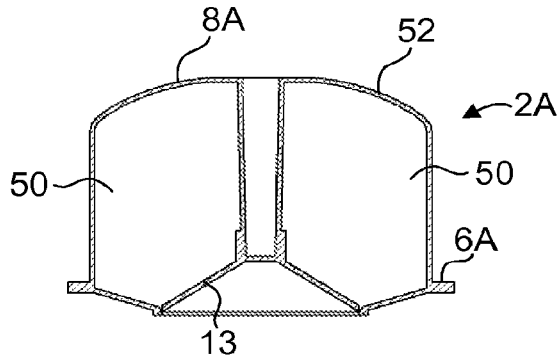
FIG. 10B is a cross sectional view of a dispensing capsule with a bubble button diaphragm in the closed (inactivated) position.
Figure 10C:
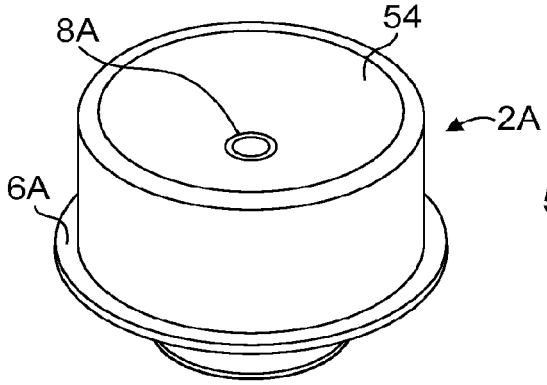
FIG. 10C is a top perspective view of a dispensing capsule with a bubble button diaphragm in the open (activated) position.
Figure 10D:
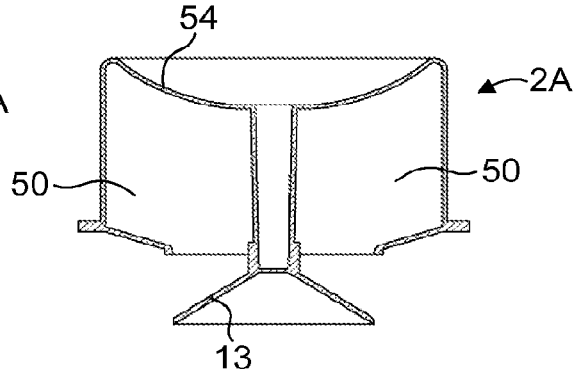
FIG. 10D is a cross sectional view of a dispensing capsule with a bubble button diaphragm in the open (activated) position.

FIG. 10A is a top perspective view of a bottom flange dispensing capsule 2A with a bubble button 8A diaphragm in the closed (inactivated) 52 position. FIG. 10B is a cross sectional view of the bottom flange dispensing capsule 2A with a bubble button 8A diaphragm in the closed (inactivated) 52 position. Applying an activating force to the bubble button 8A will activate the breakaway plunger 13 and allow communication between the cavity 50 and the receiving container 22 (not shown in this view but see FIG. 1A). FIG. 10C is a top perspective view of a bottom flange dispensing capsule 2A with a bubble button 8A diaphragm in the open (activated) 54 position. FIG. 10D is a cross sectional view of a bottom flange dispensing capsule 2A with a bubble button 8A diaphragm in the open (activated) 54 position.

Figure 10E:
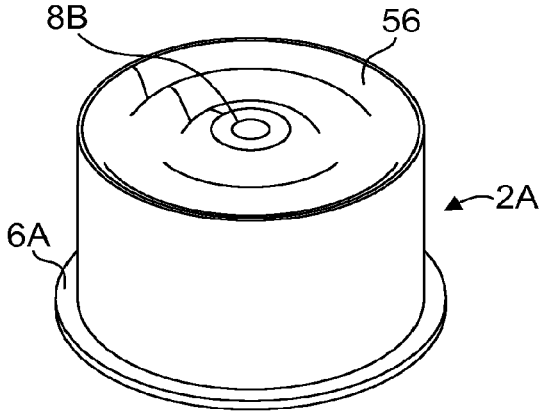
FIG. 10E is a top perspective view of a dispensing capsule with a ripple diaphragm in the closed (inactivated) position.
Figure 10F:
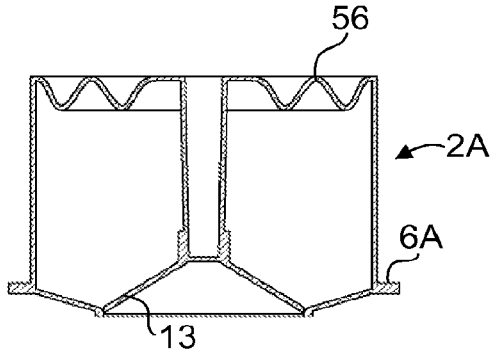
FIG. 10F is a cross sectional view of a dispensing capsule with a ripple diaphragm in the closed (inactivated) position.
Figure 11A:
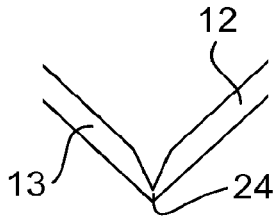
FIG. 11A is a cross section view of one embodiment of a breakaway seal.
Figure 11B:
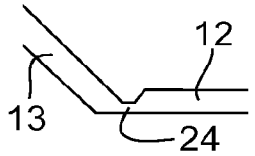
FIG. 11B is a cross section view of an alternate embodiment of a breakaway seal.
Figure 11C:
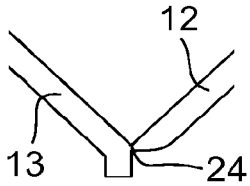
FIG. 11C is a cross section view of an alternate embodiment of a breakaway seal.
Figure 11D:
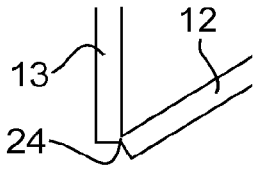
FIG. 11D is a cross section view of an alternate embodiment of a breakaway seal.
Figure 11E:
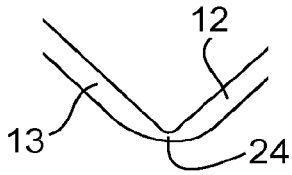
FIG. 11E is a cross section view of an alternate embodiment of a breakaway seal.

Other button and/or diaphragm configurations may be suitably adapted to the present device. The diaphragm and diaphragm button may be convex or concave. FIG. 10E is a top perspective view of a bottom flange dispensing capsule 2A with a ripple button 8B diaphragm in the closed (inactivated) 56 position and FIG. 10F is a cross sectional view of a bottom flange dispensing capsule 2A with a ripple button 8B diaphragm in the closed (inactivated) 56 position.

FIGS. 14A, 14B, 14C and 14D illustrate an embodiment of the dispensing capsule 2A configured for use with a conventional spray bottle 22 such as those typically used to hold and dispense household spray cleaners. Thus, the dispensing capsule 2A may be preloaded with concentrated detergent (or other chemical agent) and used with a receiving container 22 having a securing cap 9 in the form of a sprayer 70. When in the open position (see FIGS. 14C and 14D), the cavity 15 of the housing 5 is in fluid communication with the fluid compartment of the receiving container 22. To place the dispensing capsule 2A into an "open position", so that the contents of the cavity 15 of the housing 5 may be introduced or discharged into the communicating receiving container 22, the button 8 on the diaphragm 4 is sufficiently depressed 26 or forcefully pushed to downwardly when the securing cap 9 is threaded onto the threaded portion 68 of the sprayer bottle receiving container 22. This causes the shaft 14 to be thrust toward the receiving container 22 and attached breakaway plunger 13 to cause a predictable tear pattern and the breakaway plunger 13 is introduced into the fluid compartment of the receiving container 22, thus, enabling the contents thereof to flow through the aperture of the base plate 12 and into the liquid contents 20 of the receiving container 22. Referencing FIGS. 8C and 14D, there is also provided a central fluid channel 36 through which a tube is disposed to enable fluid communication of the liquid contents between the receiving container 22 and the sprayer 70.

It is contemplated in still another alternate embodiment that the interior surface of the receiving container 22 comprises ridges, fins or ribs (i.e., linear, curved or spiral shaped fins) integrally formed thereover to facilitate agitation of the consumable product in the dispensing capsule 2 with the liquid 20 contents after activation of the breakaway plunger 13.

It is contemplated in still another alternate embodiment that the receiving container 22 comprises a flexible bag design rather than a more structurally solid bottle as generally depicted in the Figures. By way of illustration, the receiving container may take the form of an infant disposable bottle insert or a pouch style drink container as commonly seen with products such as CAPRI SUN®.

In yet another embodiment of the present device (not depicted), the dispensing capsule 2 comprises a plurality of cavities for storing a corresponding number of separate consumable products for mixing at the time of consumption. By way of illustration, a dispensing capsule 2 may comprise three cavities that store separately freeze-dried coffee crystals, a granular or powdered sweetener and a powdered creamer. These consumable products mix with hot water in the receiving container to form a hot coffee drink.

Although the present device contemplates use of dispensing capsule 2 for applications where the receiving container 22 is filled with liquid 20 such that the mixed consumable end product is a solution or suspension, it should be recognized that dispensing capsule 2, or any dimensional variation thereof, may be utilized to facilitate the introduction and mixture of any selected ingredient, additive or the like to the contents of a communicating bottle or container 22. The technology of the present device may be appropriately modified to accommodate other applications such as a dispensing capsule 2 filled with salad dressing and a receiving container 22 filled with vegetable ingredients (e.g. lettuce, carrots, and the like) or a dispensing capsule 2 filled with milk and a receiving container 22 filled with breakfast cereal.

There may also be provided on or more adaptor components to facilitate the securing of the dispensing capsule 2 about the receiving container 22. These may include advantages such as integrated check valve air vents and/or silicone valve seals. These have special application when used with receiving containers in the form of infant feeding bottles.

Figure 23:
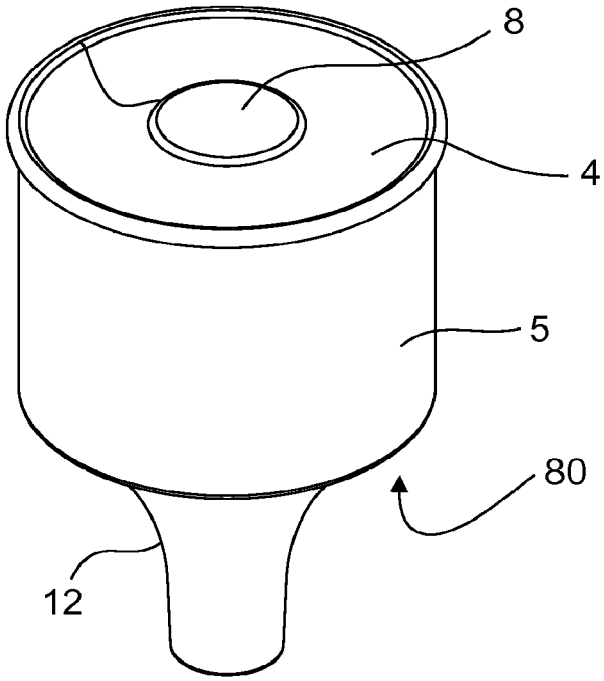
FIG. 23 is a perspective view of another embodiment of a dispensing capsule.
Figure 24:
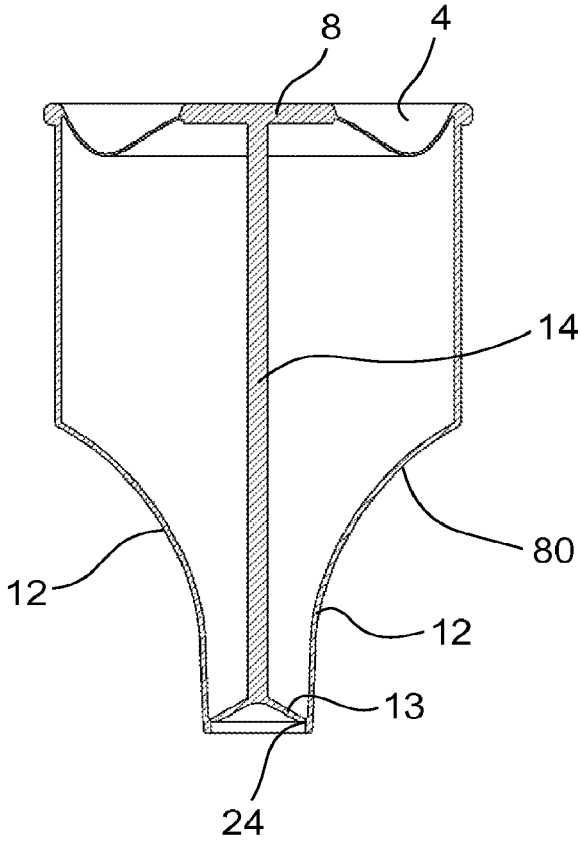
FIG. 24 is an orthogonal cross section view of the dispensing capsule depicted in FIG. 23.

Another embodiment provides a dispensing capsule that is configured to a receiving container in the form of a vehicle gasoline tank such that a user may introduce an additive to the gas tank. In this aspect, best illustrated in FIGS. 23-26, the dispensing capsule may be hand held, thus need not include a mounting flange for affixing to a receiving container. FIGS. 23 and 24 depict an embodiment of the dispensing capsule where the dispensing capsule can be activated in a user's hands while holding it in the air or while pushing it into an opening of a gasoline tank or other receiving container 22. A concave portion 80 of the base plate 12 provides a place for fingers to easily grasp the dispensing capsule during use, facilitating the activation of the breakaway. The base plate 12 is shaped, configured and adapted to be received by the gasoline tank (receiving container) 22. Pushing the button 8 activates the break away.

Figure 25:
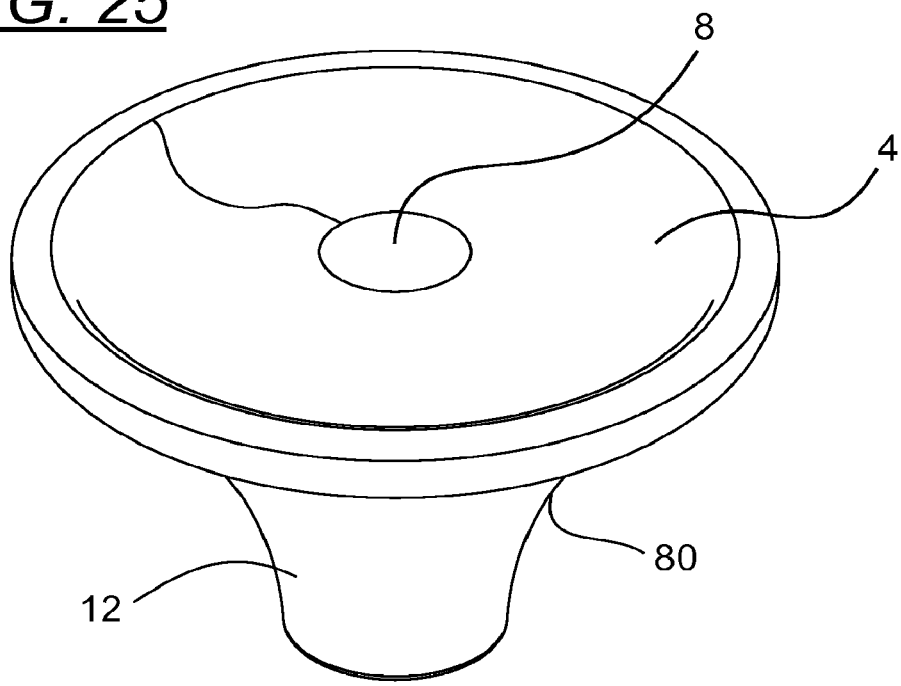
FIG. 25 is a perspective view of another embodiment of a dispensing capsule.
Figure 26:
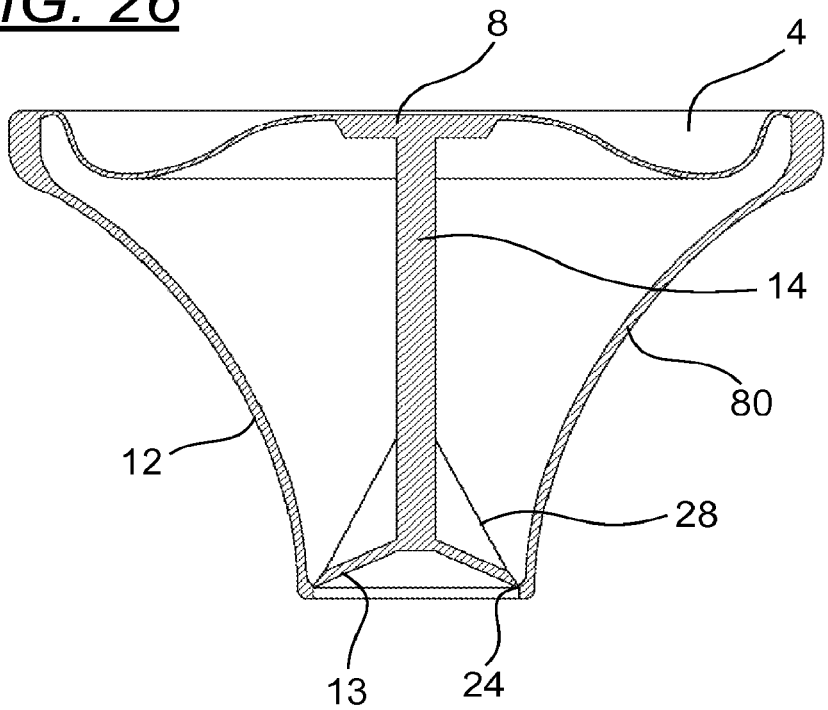
FIG. 26 is an orthogonal cross section view of the dispensing capsule depicted in FIG. 25.

Similarly, FIGS. 25 and 26 depict an embodiment of the dispensing capsule where the dispensing capsule can be activated by a user with one hand. A concave portion 80 of the base plate 12 provides a place for fingers to easily grasp the dispensing capsule during use. A wider circumference diaphragm 4 and stress concentrators 28 facilitate single hand use.

Figure 21:
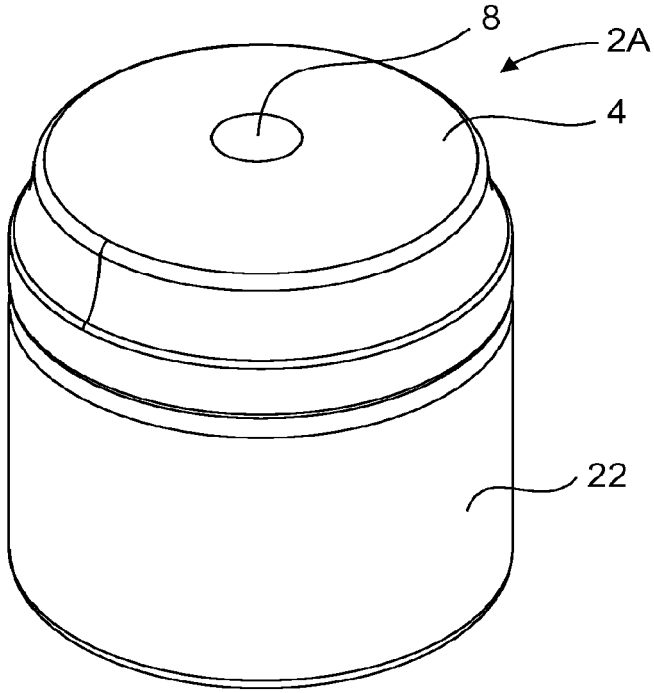
FIG. 21 is a perspective view of another embodiment of a dispensing capsule.
Figure 22:
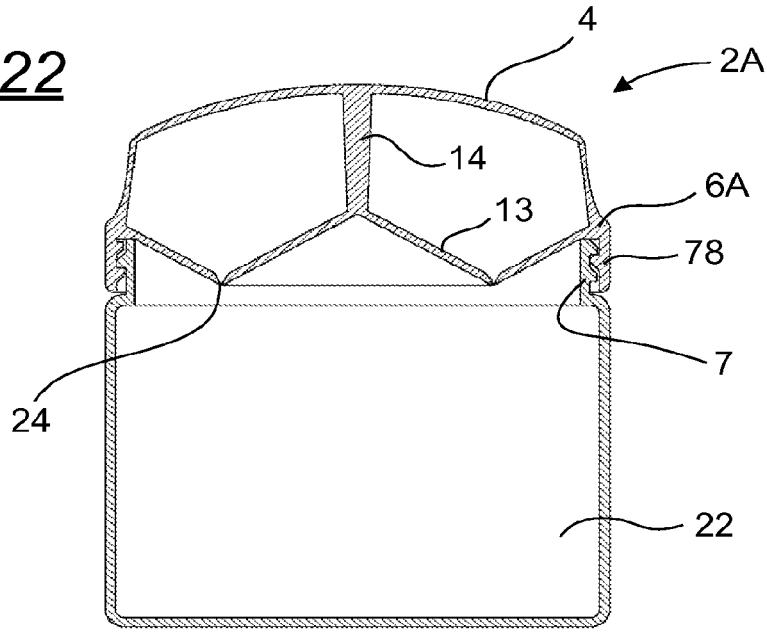
FIG. 22 is an orthogonal cross section view of the dispensing capsule depicted in FIG. 21.

FIGS. 21 and 22 depict an embodiment of the bottom flange style dispensing capsule 2A in the form of a bottle cap with an integrated dispensing capsule. The mounting flange 6A is configured correspondingly to be received by the threaded opening 7 of the receiving container 22, comprising threaded portion 78 that allows a user to screw it onto and seal the receiving container 22.

Figure 27:
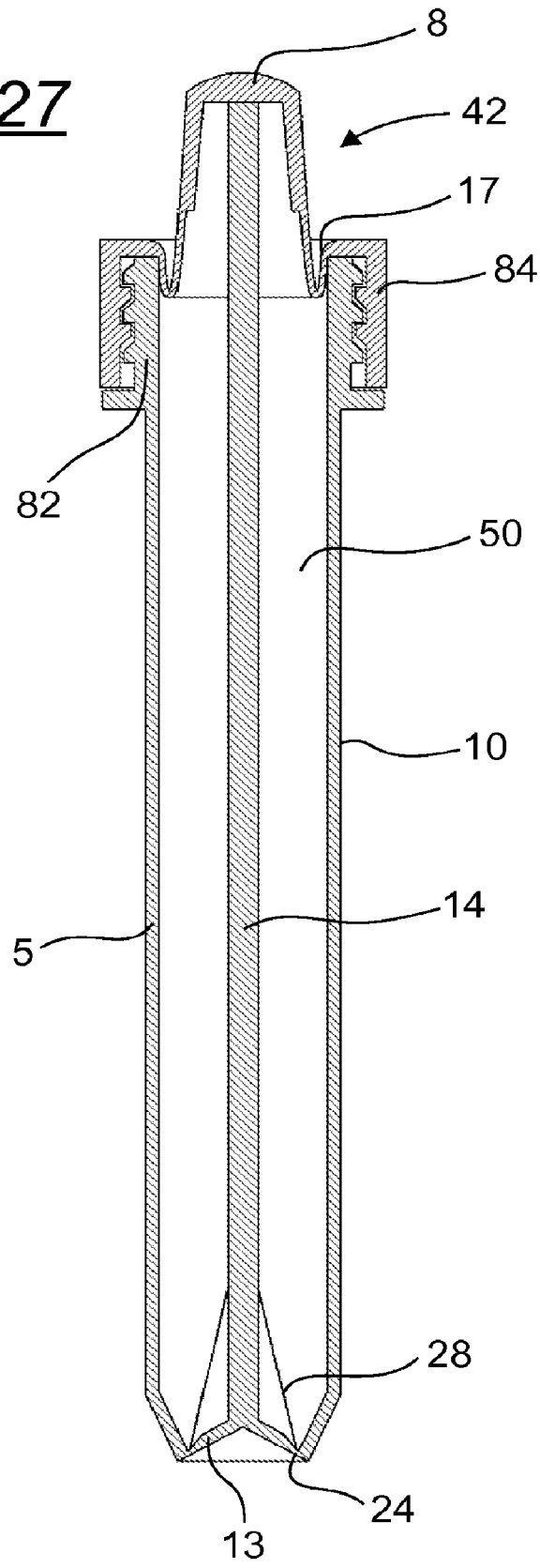
FIG. 27 is an orthogonal cross section view of another embodiment of the dispensing capsule in the form of a pen.
Figure 28:
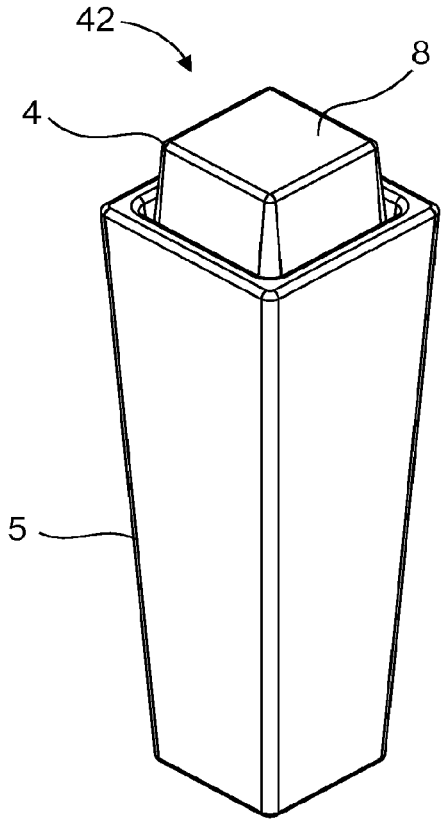
FIG. 28 is a perspective view of another embodiment of a dispensing capsule in the form of a pen.
Figure 29:
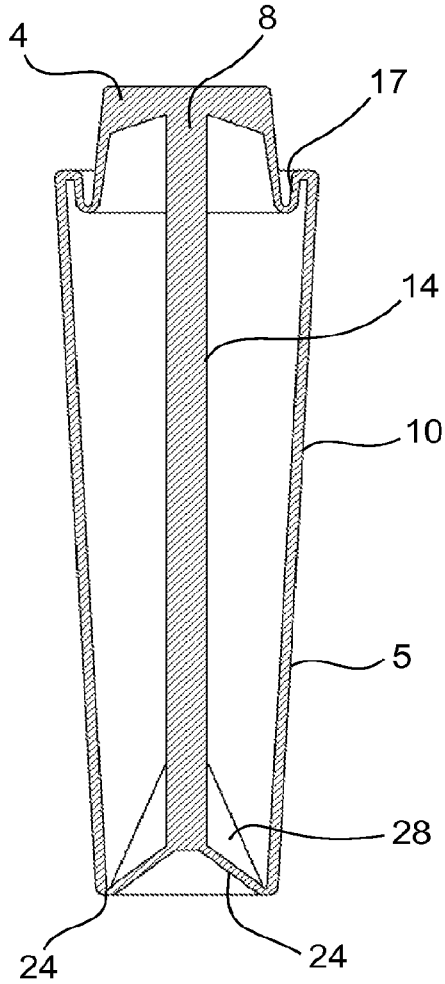
FIG. 29 is an orthogonal cross section view of the dispensing capsule depicted in FIG. 28.

FIGS. 27, 28 and 29 depict an embodiment where the dispensing capsule is configured in the form of a pen style device. The housing 5 may be cylindrical as illustrated in FIG. 27 or have other convenient tubular configurations as illustrated in FIGS. 28 and 29. The diaphragm 4 may be configured in the form of a lid 42 or integrally formed with the housing 5 side wall 10 to form the diaphragmatic seal 17. The button 8 may be rounded, square or other shapes as desired by the user or manufacturer.

In the embodiment depicted in FIG. 27, the lid 42 is configured correspondingly to be received by the threaded opening 82 of the housing 5 (at one end of the side wall 10), comprising mating threaded portion 84 that allows a user to screw the lid 42 onto and seal 17 the housing 5 such that cavity 50 is formed therein. To use the pen style dispensing capsule, a user wraps his fingers around and holds the capsule in the palm of his hand while activating the button 8 with his thumb.

Figure 30:
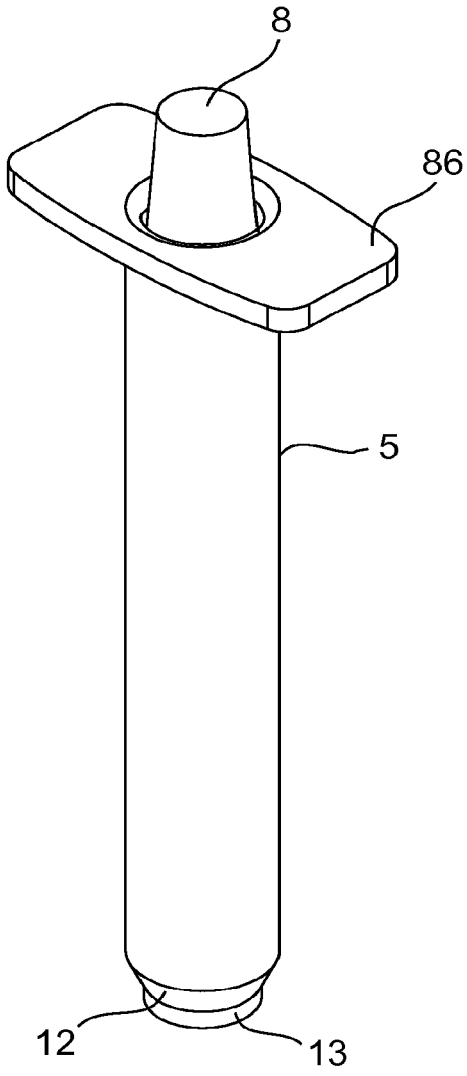
FIG. 30 is a perspective view of another embodiment of a dispensing capsule in the form of a syringe.
Figure 31:
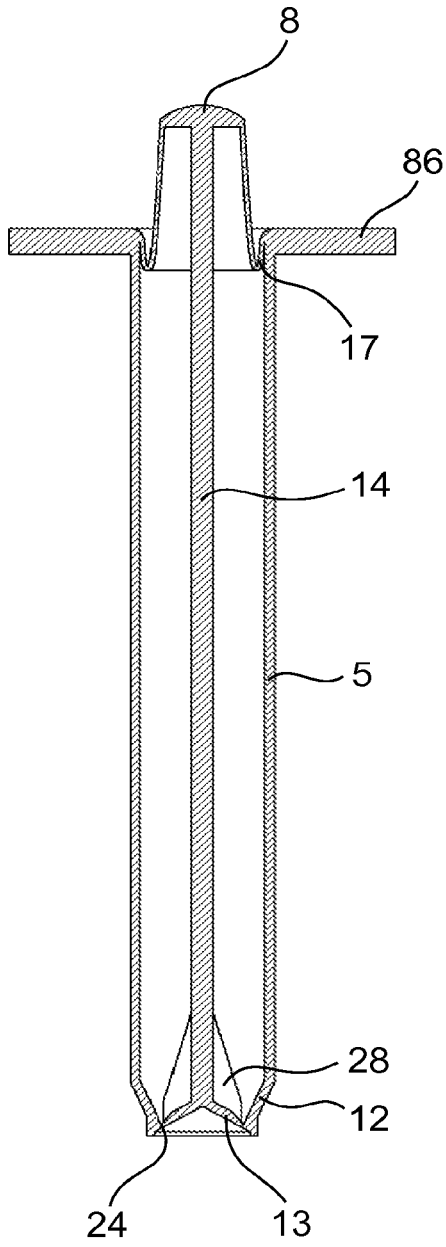
FIG. 31 is an orthogonal cross section view of the dispensing capsule depicted in FIG. 30.

FIGS. 30 and 31 depict an embodiment where the dispensing capsule is configured in the form of a syringe style device having a protruding lip 86 for fingers to grip during use. The housing 5 may be cylindrical as illustrated in FIGS. 30 and 31 or have other convenient tubular configurations as illustrated in FIGS. 28 and 29.

Thus, having broadly outlined the more important features of the present device in order that the detailed description thereof may be better understood, and that the present contribution to the art may be better appreciated, there are, of course, additional features of the present device that will be described herein and will form a part of the subject matter of the claims appended to this specification.

As such, those skilled in the art will appreciate that the conception, upon which this disclosure is based, may readily be utilized as a basis for the designing of other structures, methods and systems for carrying out the several purposes of the present device. It is important, therefore, that the claims be regarded as including such equivalent construction insofar as they do not depart from the spirit and scope of the conception regarded as the present invention.

What is claimed herein is:

1. A dispensing capsule for affixing to an opening of a receiving container where the dispensing capsule comprises a housing having a cavity therein for separately hermetically storing preloaded contents within the cavity when the dispensing capsule is disposed in a closed position, the housing of the dispensing capsule further comprises a breakaway plunger and a base plate having an aperture that cooperate to form a seal between the cavity and a liquid compartment of the receiving container, the housing further comprises a diaphragm and a diaphragm button integral to the diaphragm and disposed in concentric axial alignment with the breakaway plunger and a shaft having a central axis that is fixedly connected at one end to the diaphragm button and at the opposing end to the breakaway plunger, wherein the breakaway plunger comprises a substantially circular periphery and the shaft is concentrically disposed with respect to the periphery such that the central axis of the shaft is substantially perpendicularly disposed to a plane formed by the periphery, and an activating force applied to the diaphragm button causes the dispensing capsule to be disposed in an open position such that the breakaway plunger disengages symmetrically about the center of the plane from the base plate to break the seal along the periphery and the breakaway plunger is thrust toward the receiving container, thereby creating liquid communication between the fluid compartment and cavity such that the preloaded contents of the cavity are discharged through the aperture of the base plate into the communicating fluid compartment of the receiving container whereby the activating force allows the breakaway plunger and the shaft to remain attached to the diaphragm button and the activating force causes no relative movement between the diaphragm and the diaphragm button.

2. The dispensing capsule as recited in claim 1, wherein the breakaway plunger comprises a conical shaped plunger having a plurality of blades disposed in a multitude of orientations configured to cause turbulence during agitation of the receiving container such that there is uniform mixing of the preloaded contents with a liquid in the receiving container.

3. The dispensing capsule as recited in claim 1, wherein the breakaway plunger comprises a conical shaped plunger having a plurality of blades disposed in a multitude of orientations configured to cause turbulence during agitation of the receiving container such that there is rapider mixing of the preloaded contents with a liquid in the receiving container.

4. The dispensing capsule as recited in claim 1, wherein the dispensing capsule further comprises a base plate that is adapted to be received by a receiving container in the form of a vehicle gasoline tank.

5. The dispensing capsule as recited in claim 1, wherein the dispensing capsule further comprises a mounting flange that is adapted to be received by a receiving container in the form of an infant feeding bottle.

6. The dispensing capsule as recited in claim 1, wherein the dispensing capsule further comprises a mounting flange that is adapted to be received by a mouth of a receiving container in the form of a bottle of drinking water.

7. The dispensing capsule as recited in claim 1, wherein the dispensing capsule further comprises a mounting flange that is adapted to be received by a mouth of a receiving container in the form of a spray bottle.

8. A dispensing capsule for affixing to an opening of a receiving container having a liquid compartment therein, wherein the dispensing capsule comprises a housing having a cavity therein for separately hermetically storing preloaded contents within the cavity when the dispensing capsule is disposed in a closed position, the housing further comprising:

a breakaway plunger, and a base plate having an aperture, and a diaphragm including a diaphragm button wherein the breakaway plunger and base plate cooperate to form a seal between the cavity and the liquid compartment of the receiving container, and the housing, base plate and breakaway plunger are all constructed from a single injection molding.

9. The dispensing capsule as recited in claim 8, wherein the seal comprises a non-perforated uniform and hermetic seal at the periphery of the breakaway plunger.

10. A dispensing capsule for affixing to an opening of a receiving container where the dispensing capsule comprises a housing having a cavity therein for separately hermetically storing preloaded contents within the cavity when the dispensing capsule is disposed in a closed position, the housing of the dispensing capsule further comprises a breakaway plunger and a base plate having an aperture that cooperate to form a seal between the cavity and a liquid compartment of the receiving container, and a shaft that is connected at one end to the breakaway plunger and at an opposing second end to a diaphragm, and an activating force applied to the shaft causes the dispensing capsule to be disposed in an open position such that the breakaway plunger disengages from the base plate to break the seal, the breakaway plunger fully detaches at its periphery while remaining attached to the shaft such that it does not fall into the liquid compartment, and the breakaway plunger is thrust toward the receiving container, thereby creating liquid communication between the fluid compartment and cavity such that the preloaded contents of the cavity are discharged through the aperture of the base plate into the communicating liquid compartment of the receiving container and the breakaway plunger and the shaft remain connected to the diaphragm.

11. The dispensing capsule as recited in claim 10, wherein the shaft is secured at the opposing second end to a diaphragm button such that the breakaway plunger is restricted to vertical movement along a central axis of the shaft and transmits an axially applied force to the diaphragm button to the seal such that it fully detaches the periphery of the breakaway plunger.

12. The dispensing capsule as recited in claim 10, wherein the breakaway plunger comprises an inclined surface such that a gravitational force urges the preloaded contents of the cavity to discharge through the aperture of the base plate into the communicating fluid compartment of the receiving container.

13. The dispensing capsule as recited in claim 10, wherein the breakaway plunger comprises a plurality of stress concentrators.

14. The dispensing capsule as recited in claim 13, wherein the plurality of stress concentrators comprise a plurality of stress concentrators disposed along the periphery of the breakaway plunger such that when the breakaway plunger is activated, the plurality of stress concentrators cause the seal at the periphery of the breakaway plunger to detach according to the magnitude of stress generated at each stress concentrator.

15. The dispensing capsule as recited in claim 10, wherein the plurality of stress concentrators comprise stress concentrators having varying geometry disposed along the periphery of the breakaway plunger such that when the breakaway plunger is activated, the stress concentrators cause a uniform seal at the periphery of the breakaway plunger to detach according to the magnitude of stress generated at each stress concentrator.

16. The dispensing capsule as recited in claim 13, wherein the plurality of stress concentrators distribute a force applied axially along the breakaway plunger to predetermined portions of the seal equally disposed along the periphery of the breakaway plunger such that when the breakaway plunger is activated, the plurality of stress concentrators cause the uniform seal to rupture and detach at the predetermined portions of the seal where stress is generated by the plurality of stress concentrators followed by a progressive ripping on either side of the predetermined portions until the seal has been broken around the entire periphery of the breakaway plunger.

17. The dispensing capsule as recited in claim 13, wherein the plurality of stress concentrators comprise a plurality of stress concentrating ribs disposed along the periphery such that when the breakaway plunger is activated, the plurality of stress concentrating ribs cause the seal at the periphery to detach according to the magnitude of stress generated at each stress concentrating rib.

18. The dispensing capsule as recited in claim 17, wherein the plurality of stress concentrators concentrate an axially transmitted force and direct it to predetermined portions of the seal that are equally distributed around the periphery of the breakaway plunger such that a predictable breakaway pattern is created.

19. The dispensing capsule as recited in claim 10, wherein the housing further comprises the diaphragm, thereby creating a flexible cavity volume such that an excessive pressure in the sealed cavity is relieved.

20. The dispensing capsule as recited in claim 19, wherein the breakaway plunger is disposed concentrically to the diaphragm such that a non-axial force applied to a button on the diaphragm is transmitted axially through the breakaway plunger to create stress on the seal thereby causing it to break away.

21. A dispensing capsule for affixing to an opening of a receiving container where the dispensing capsule comprises a housing having a cavity therein for separately hermetically storing preloaded contents within the cavity when the dispensing capsule is disposed in a closed position, the housing of the dispensing capsule further comprises a first portion comprising a cup, a breakaway plunger having a central axis and a base plate having an aperture that cooperate to form a seal between the cavity and a liquid compartment of the receiving container, and a shaft that is connected at one end to the breakaway plunger, a second portion comprising a lid having a diaphragm, a diaphragm button, a seal and a shaft guide such that the shaft guide guides the lid onto the shaft and removably affixes the lid to the shaft thereto, wherein an activating force applied to the shaft causes the dispensing capsule to be disposed in an open position such that the breakaway plunger disengages from the base plate to break the seal, the breakaway plunger fully detaches at its periphery while remaining attached to the shaft such that it does not fall into the liquid compartment, and the breakaway plunger is thrust toward the receiving container, thereby creating fluid communication between the liquid compartment and cavity such that the preloaded contents of the cavity are discharged through the aperture of the base plate into the communicating liquid compartment of the receiving container and the shaft remains affixed to the lid.

22. A dispensing capsule where the dispensing capsule comprises a housing having a cavity therein for hermetically storing preloaded contents within the cavity when the dispensing capsule is disposed in a closed position, the housing of the dispensing capsule further comprises a breakaway plunger having a central axis and a base plate having an aperture that cooperate to form a seal that holds the preloaded contents in the cavity, the housing further comprises a diaphragm and a diaphragm button integral to the diaphragm and disposed in concentric axial alignment with the breakaway plunger and a shaft having a central axis that is fixedly connected at one end to the diaphragm button and at the opposing end to the breakaway plunger, wherein the breakaway plunger comprises a substantially circular periphery and the shaft is concentrically disposed with respect to the periphery such that the central axis of the shaft is substantially perpendicularly disposed to a plane formed of the periphery, the housing further comprises a plurality of stress concentrators symmetrically disposed about the central axis of the breakaway plunger, wherein each of the plurality of stress concentrators comprises a substantially planar structure disposed substantially perpendicularly to the plane formed by the periphery with the substantially planar structure structurally attached to the breakaway plunger and spanning at least a portion of the breakaway plunger and terminating at the periphery, and an activating force applied to the diaphragm button causes the dispensing capsule to be disposed in an open position such that the breakaway plunger disengages from the base plate to break the seal and the breakaway plunger is thrust outwardly from the aperture, thereby creating an opening according to the magnitude of stress generated at each stress concentrator with a predictable breakaway pattern such that the preloaded contents of the cavity are discharged through the aperture of the base plate and there is no relative movement between the diaphragm and the diaphragm button and the diaphragm creates a flexible volume of the cavity such that an excessive pressure in the sealed cavity is relieved.

23. The dispensing capsule as recited in claim 22, wherein the housing is pen-shaped.

24. The dispensing capsule as recited in claim 22, wherein the housing is syringe-shaped.

25. The dispensing capsule as recited in claim 22, wherein the breakaway plunger comprises a plurality of stress concentrators.

26. The dispensing capsule as recited in claim 22, wherein the housing, base plate and breakaway plunger are constructed from a single injection molding.

27. The dispensing capsule as recited in claim 26, wherein the seal comprises a non-perforated uniform and hermetic seal at the periphery of the breakaway plunger.

28. The dispensing capsule as recited in claim 22, wherein the base plate of the housing is configured to be received by a gasoline tank.

* * * * *